US009905076B2

(12) United States Patent
Landen

(10) Patent No.: US 9,905,076 B2
(45) Date of Patent: Feb. 27, 2018

(54) SYSTEM AND METHOD OF BET-MATCHING AND CHANCE-ELEMENT FEATURES FOR MULTI-PLAYER ONLINE SKILL GAMES

(71) Applicant: Todd L. Landen, Weston, CT (US)

(72) Inventor: Todd L. Landen, Weston, CT (US)

(73) Assignee: Todd L. Landen, Weston, CT (US)

( * ) Notice: Subject to any disclaimer, the term of this patent is extended or adjusted under 35 U.S.C. 154(b) by 420 days.

(21) Appl. No.: 14/582,967

(22) Filed: Dec. 24, 2014

(65) Prior Publication Data

US 2015/0187172 A1 Jul. 2, 2015

Related U.S. Application Data

(60) Provisional application No. 61/922,362, filed on Dec. 31, 2013.

(51) Int. Cl.
*G07F 17/32* (2006.01)

(52) U.S. Cl.
CPC ..... *G07F 17/3227* (2013.01); *G07F 17/323* (2013.01); *G07F 17/3279* (2013.01)

(58) Field of Classification Search
USPC ..... 463/11, 12, 13
See application file for complete search history.

(56) References Cited

U.S. PATENT DOCUMENTS

2004/0097287 A1* 5/2004 Postrel ..... G07F 17/32 463/41
2007/0112706 A1 5/2007 Herbrich et al.
2012/0064968 A1 3/2012 Youm et al.
2012/0115554 A1 5/2012 Cairns et al.
2013/0296035 A1 11/2013 Herrmann

OTHER PUBLICATIONS

International Search Report dated Apr. 8, 2015 for International Application No. PCT/US14/72388.

* cited by examiner

*Primary Examiner* — Pierre E Elisca
(74) *Attorney, Agent, or Firm* — Howard & Howard Attorneys PLLC

(57) ABSTRACT

A system and method for providing matching of bets for an online skill game includes a display device for displaying the game and a computer coupled to the display device. The computer is configured to analyze a skill level of a first player based on the playing history of the first player, to analyze a skill level of a second player based on the playing history of the second player, to generate an initial proposal for a fair match between the first player and the second player based on the analyzed skill levels, and to communicate the initial proposal either one of the first player or the second player, and wherein either the first player or the second player accepts or rejects the initial proposal by communicating the acceptance or rejection to the computer.

32 Claims, 24 Drawing Sheets

Game Boards, Different Sizes

Icons for Chess Pieces, and New Pieces

Fig. 18, Mage

Fig. 19, Archer

Fig. 21, Pawn "Reborn"

Fig. 22, War Definition

Sample Battles and Starting Positions

Fig. 26, Battle Order Shuffled and Varied
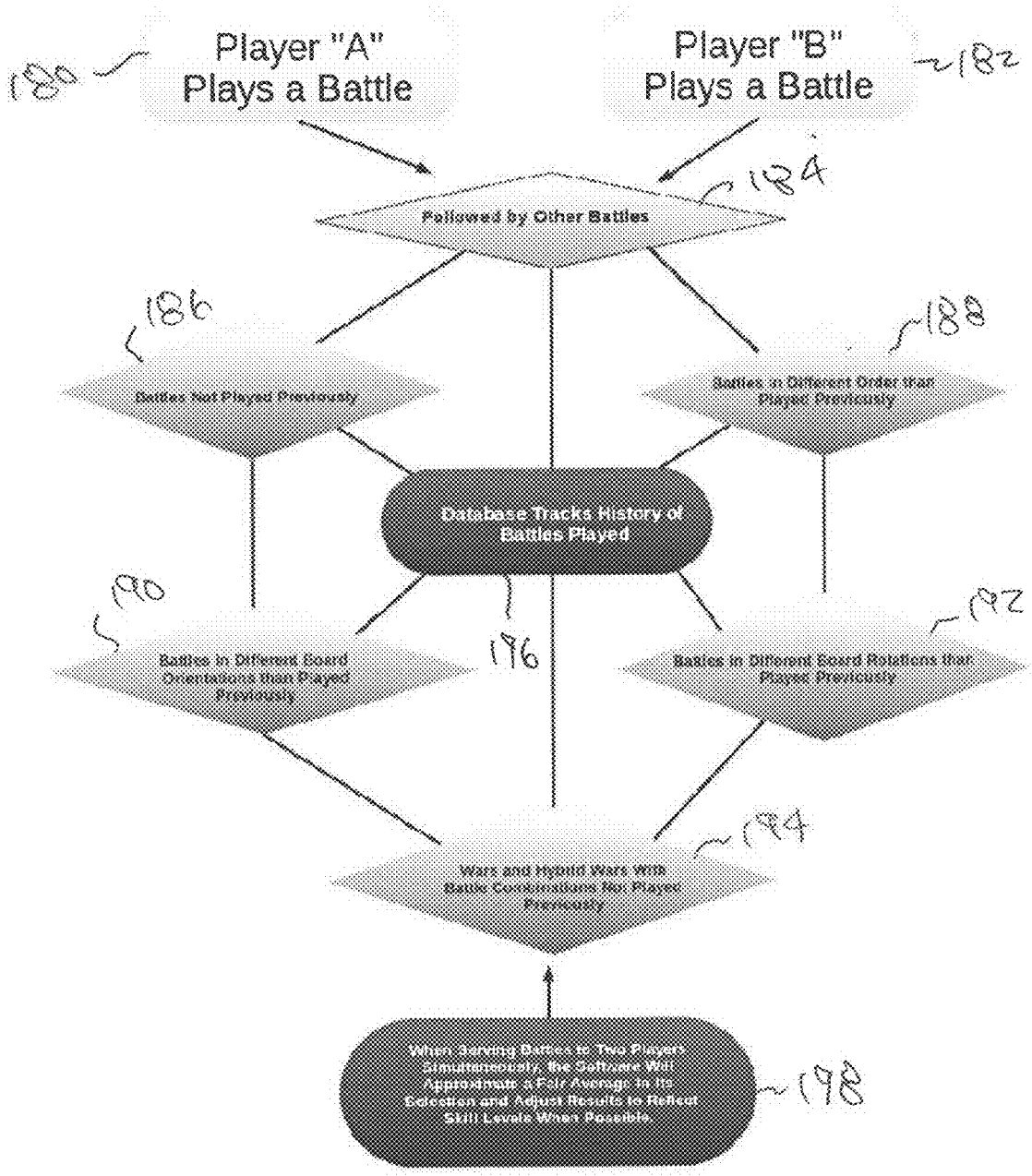

Game-Board Rotation
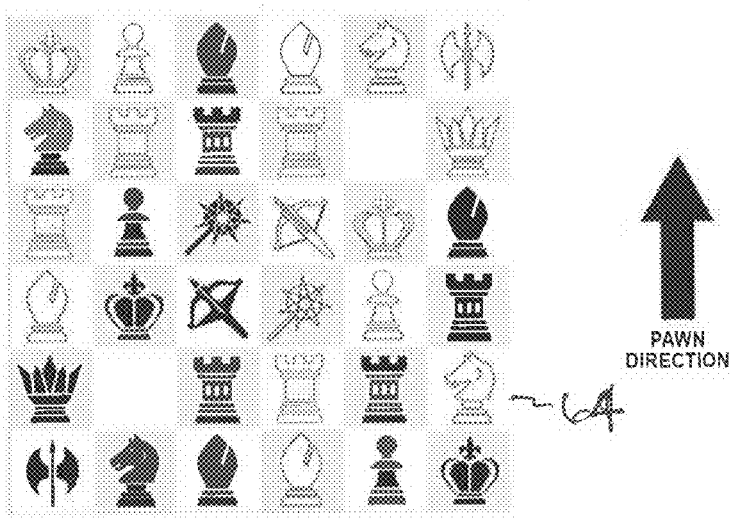
Fig. 27 at 0% rotation.
Play as white.
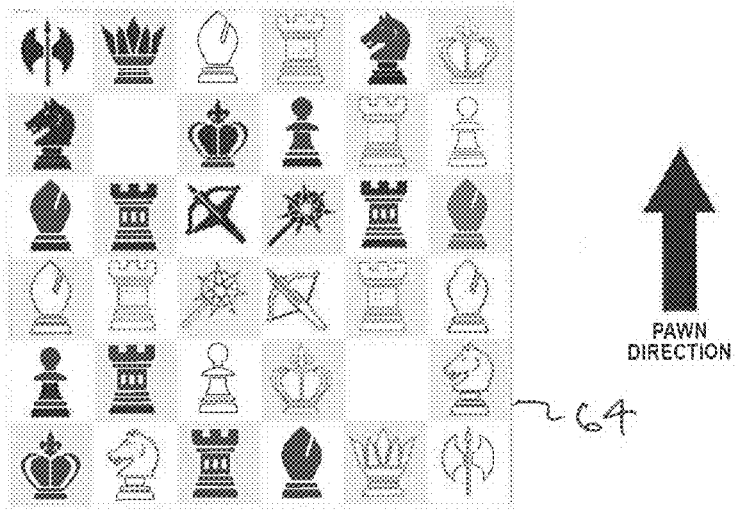
Fig. 28 at 90% rotation.
Play as white.

Game-Board Rotation
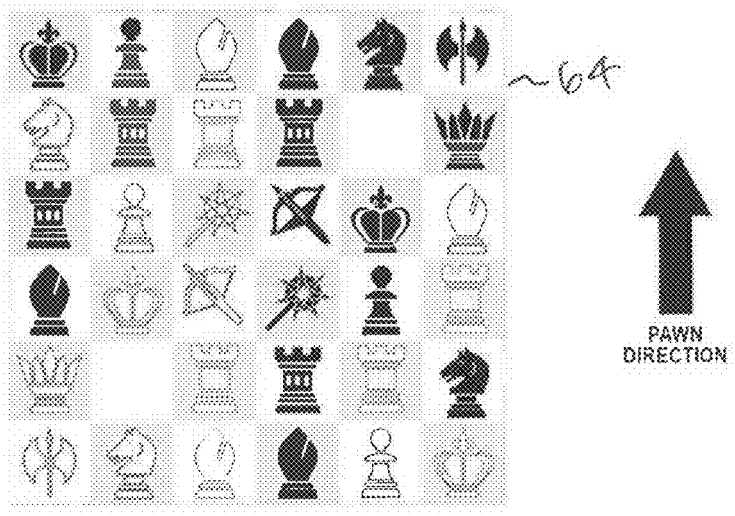
Fig. 29 at 180% rotation.
Play as white.
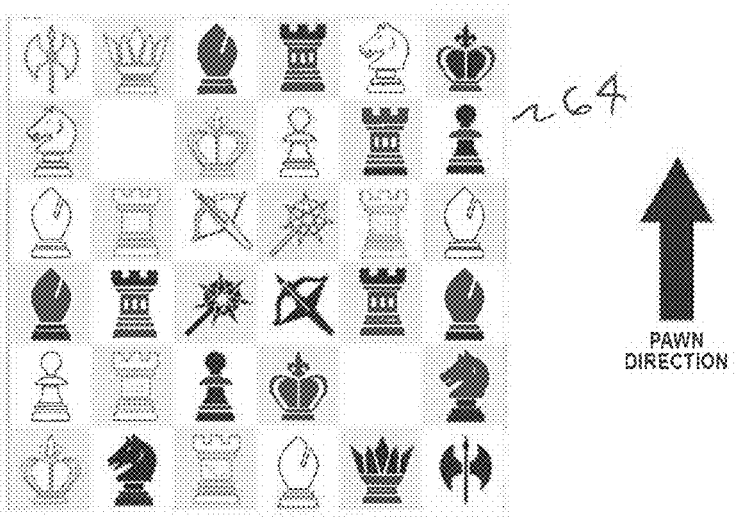
Fig. 30 at 270% rotation.
Play as white.

Switched Sides
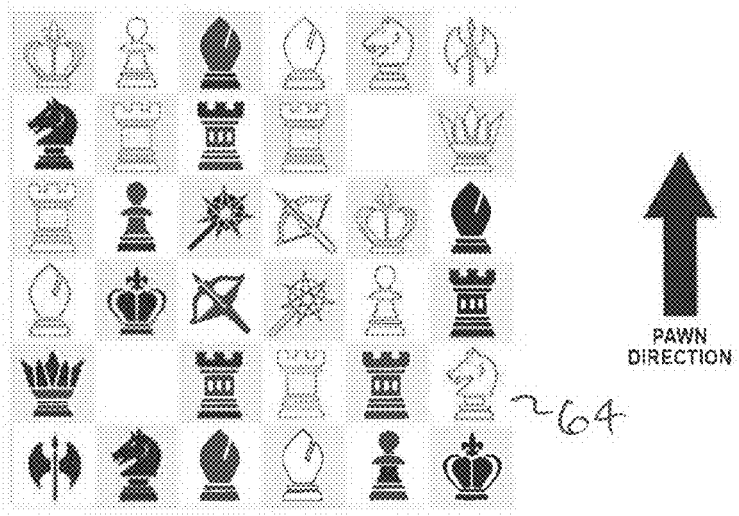
Fig. 31 at 0% rotation.
Switched sides: play as black.
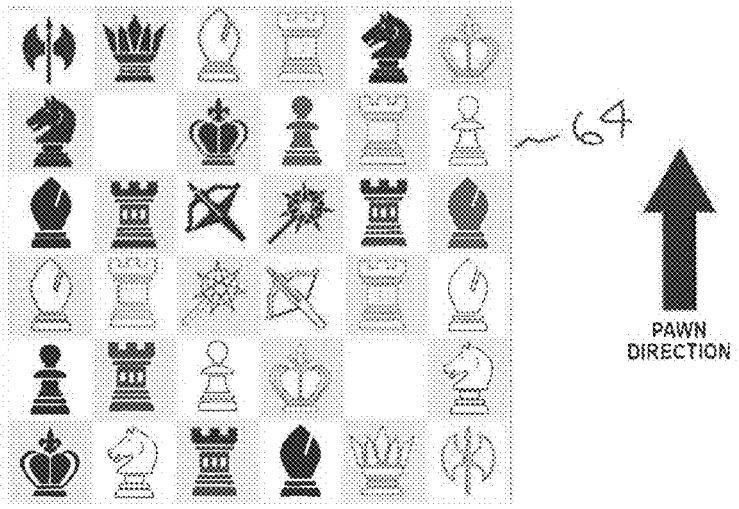
Fig. 32 at 90% rotation.
Switched sides: play as black.

Switched Sides
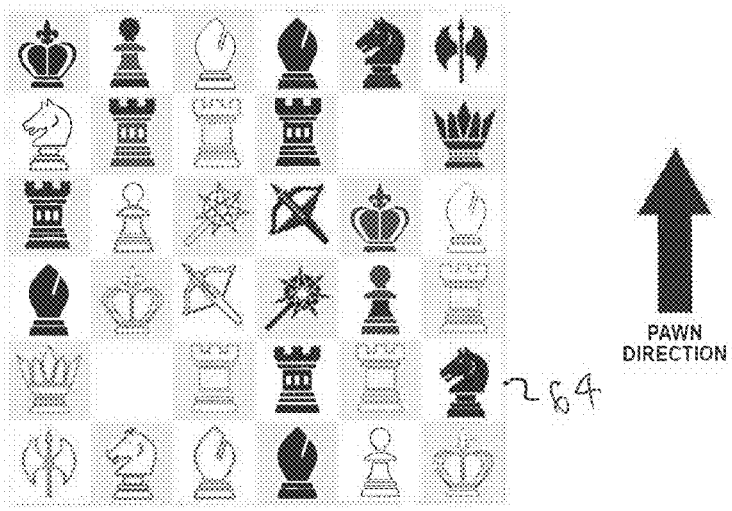
Fig. 33 at 180% rotation.
Switched sides: play as black.
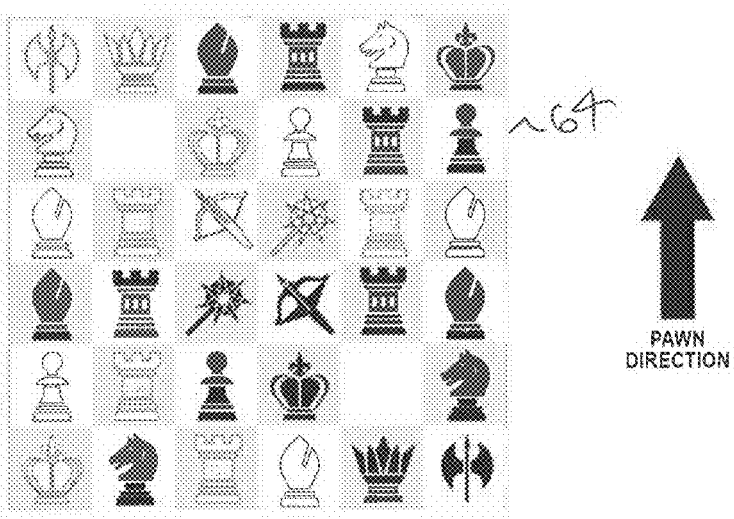
Fig. 34 at 270% rotation.
Switched sides: play as black.

Ghost Mode
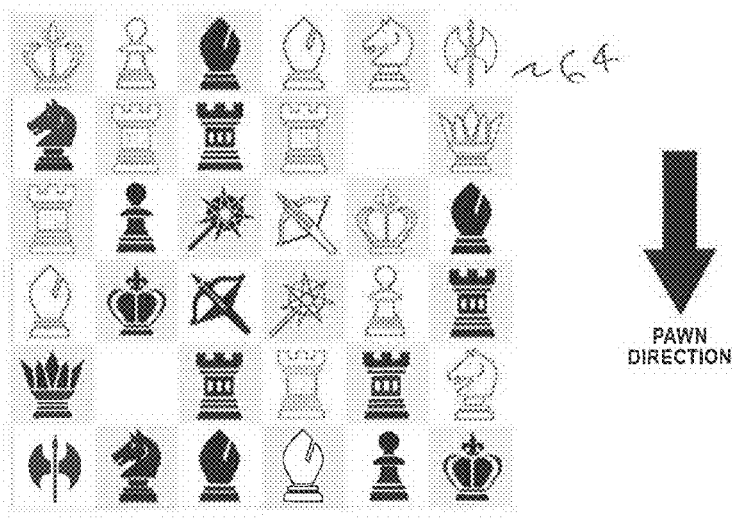
Fig. 35 at 0% rotation.
Ghost Mode: play as white.
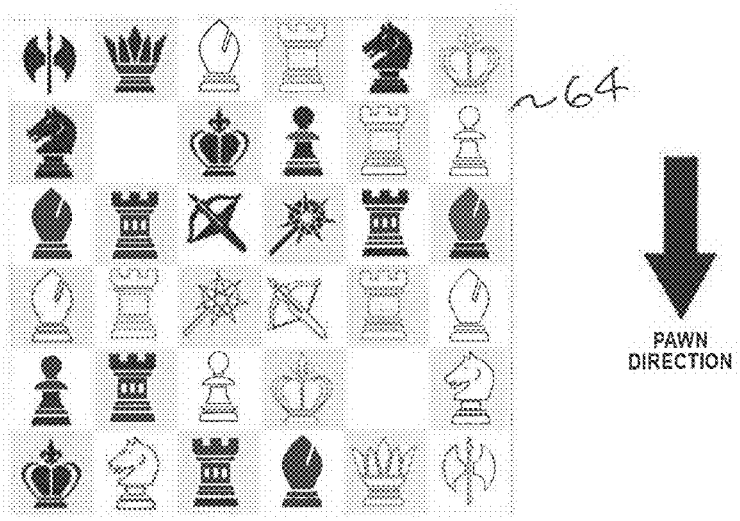
Fig. 36 at 90% rotation.
Ghost Mode: play as white.

Ghost Mode
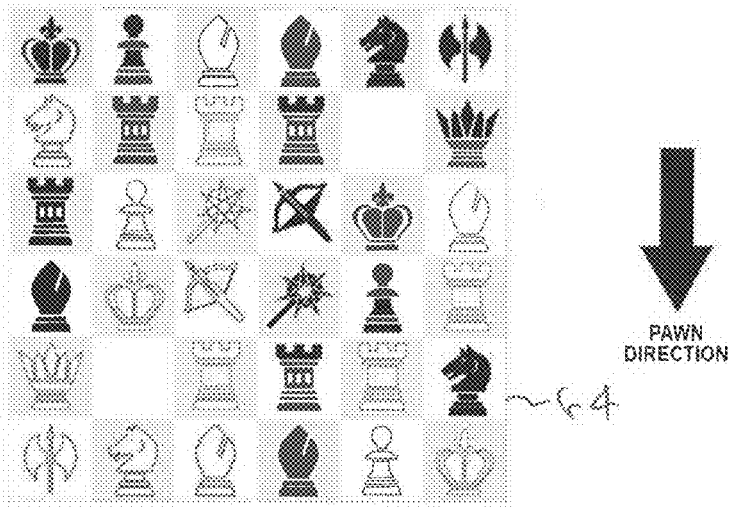
Fig. 37 at 180% rotation.
Ghost Mode: play as white.
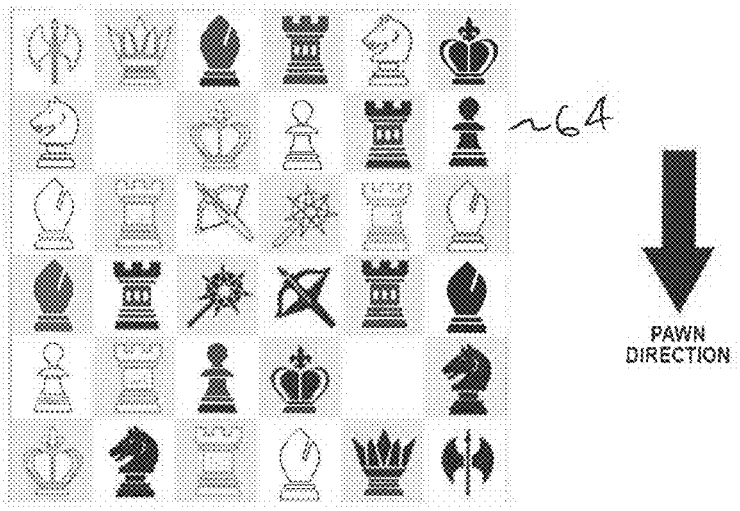
Fig. 38 at 270% rotation.
Ghost Mode: play as white.

Switched Sides and Ghost Mode
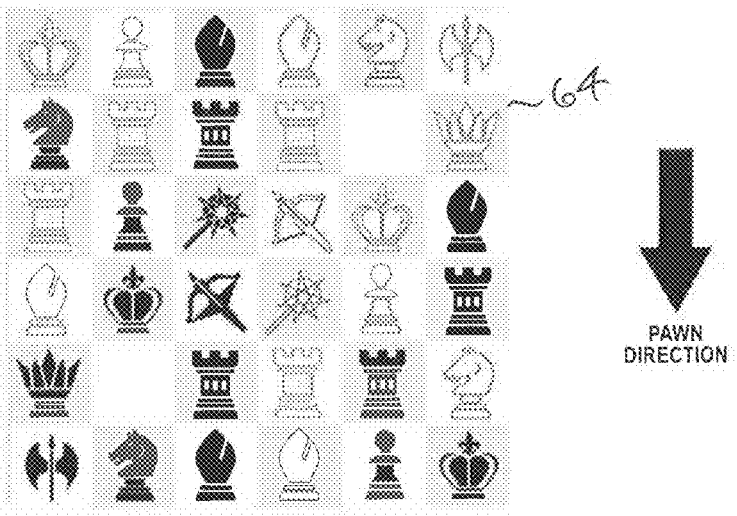
Fig. 39 at 0% rotation.
Ghost Mode: play as black.
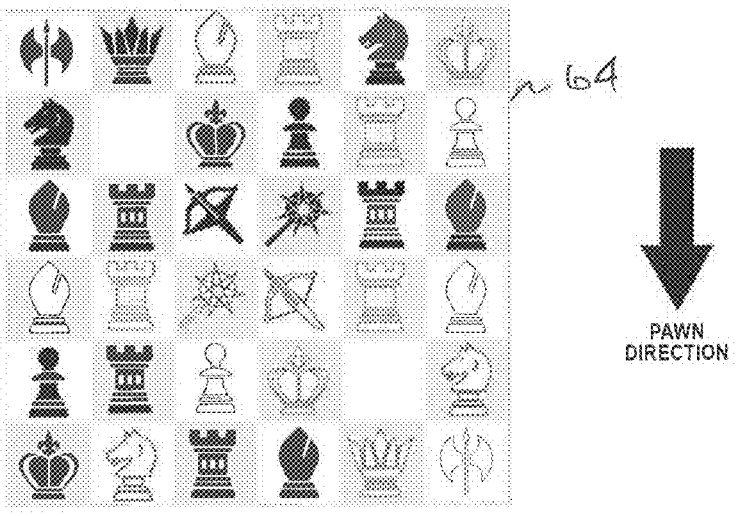
Fig. 40 at 90% rotation.
Ghost Mode: play as black.

Switched Sides and Ghost Mode
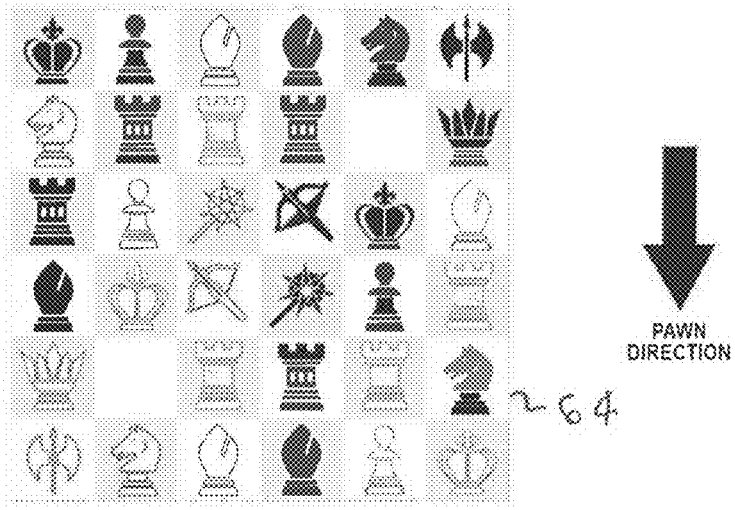
Fig. 41 at 180% rotation.
Ghost Mode: play as black.
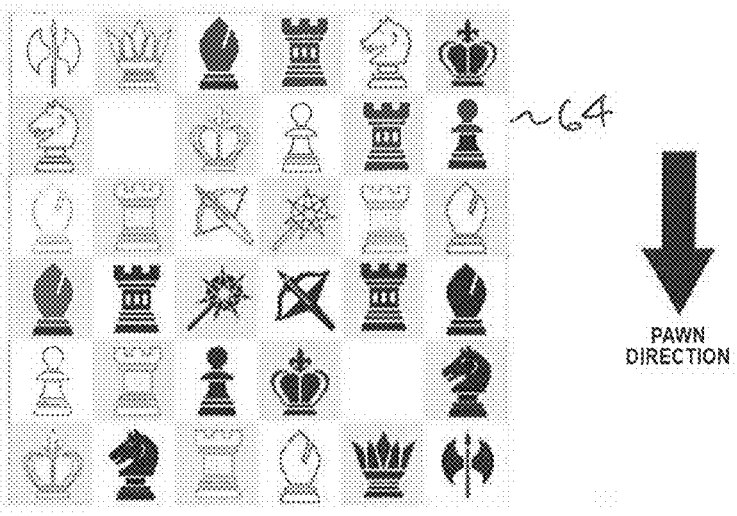
Fig. 42 at 270% rotation.
Ghost Mode: play as black.

Fig. 43, Hybrid Wars
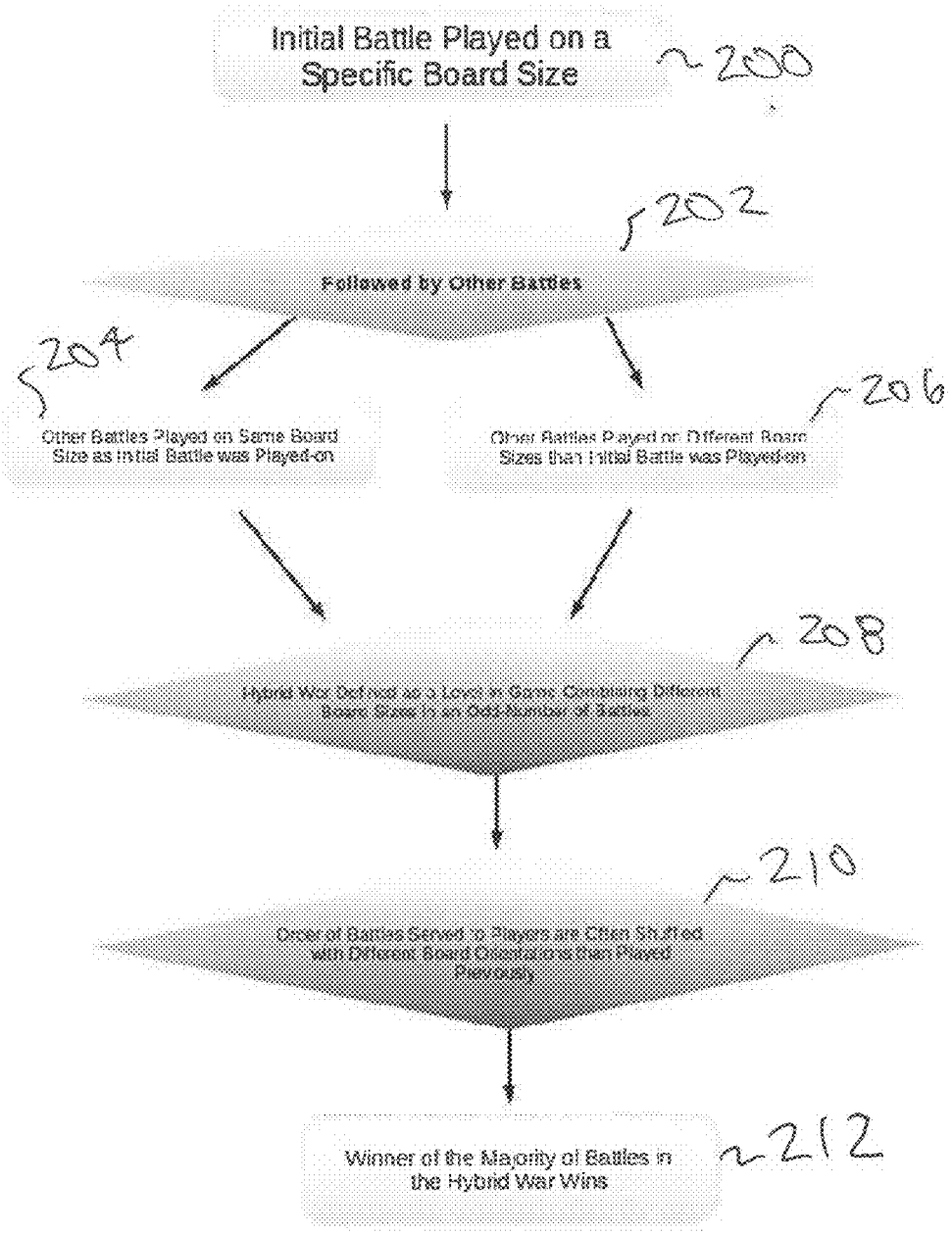

Fig. 44, Levels
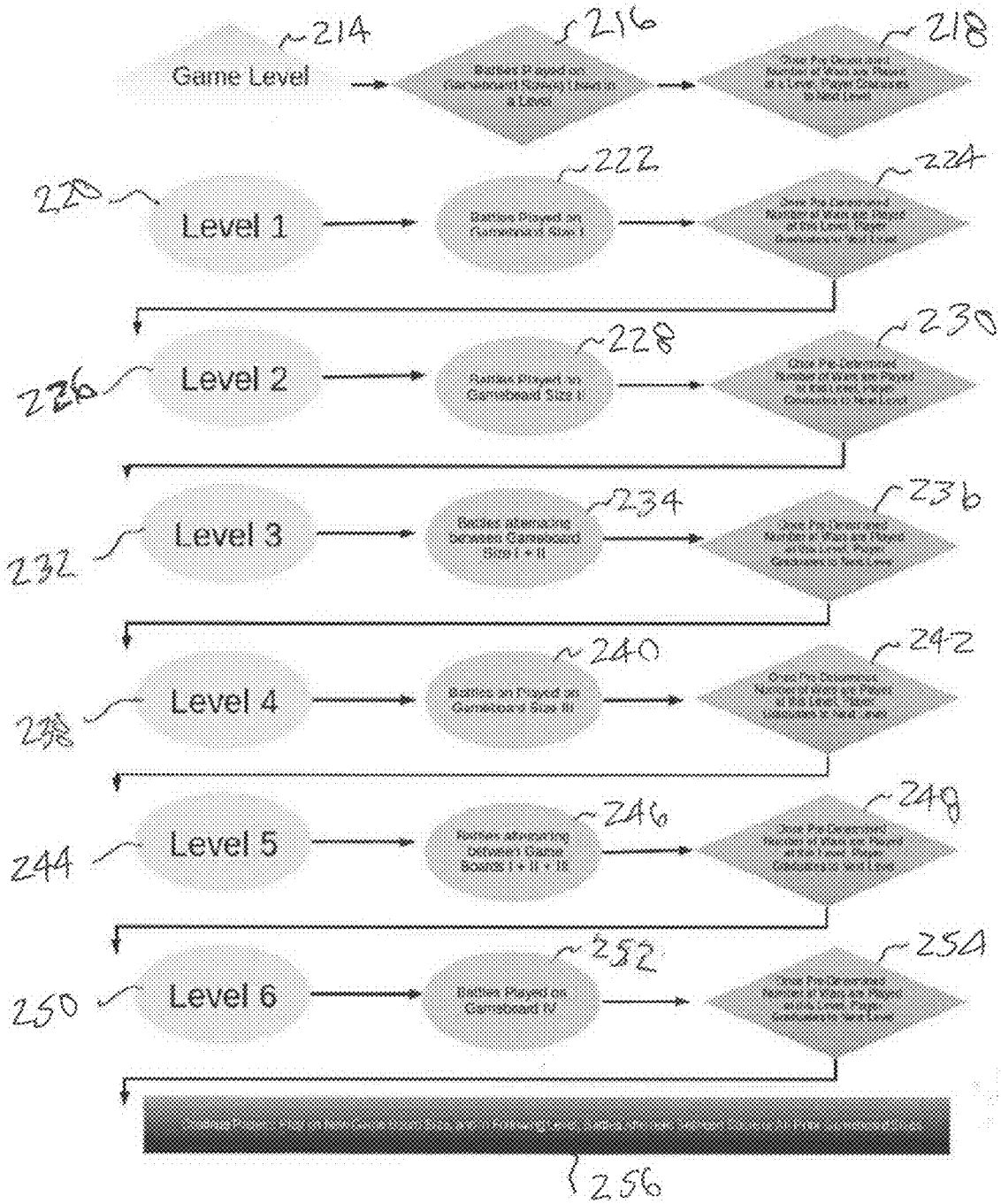

Fig. 45, Bet Matching Methodology
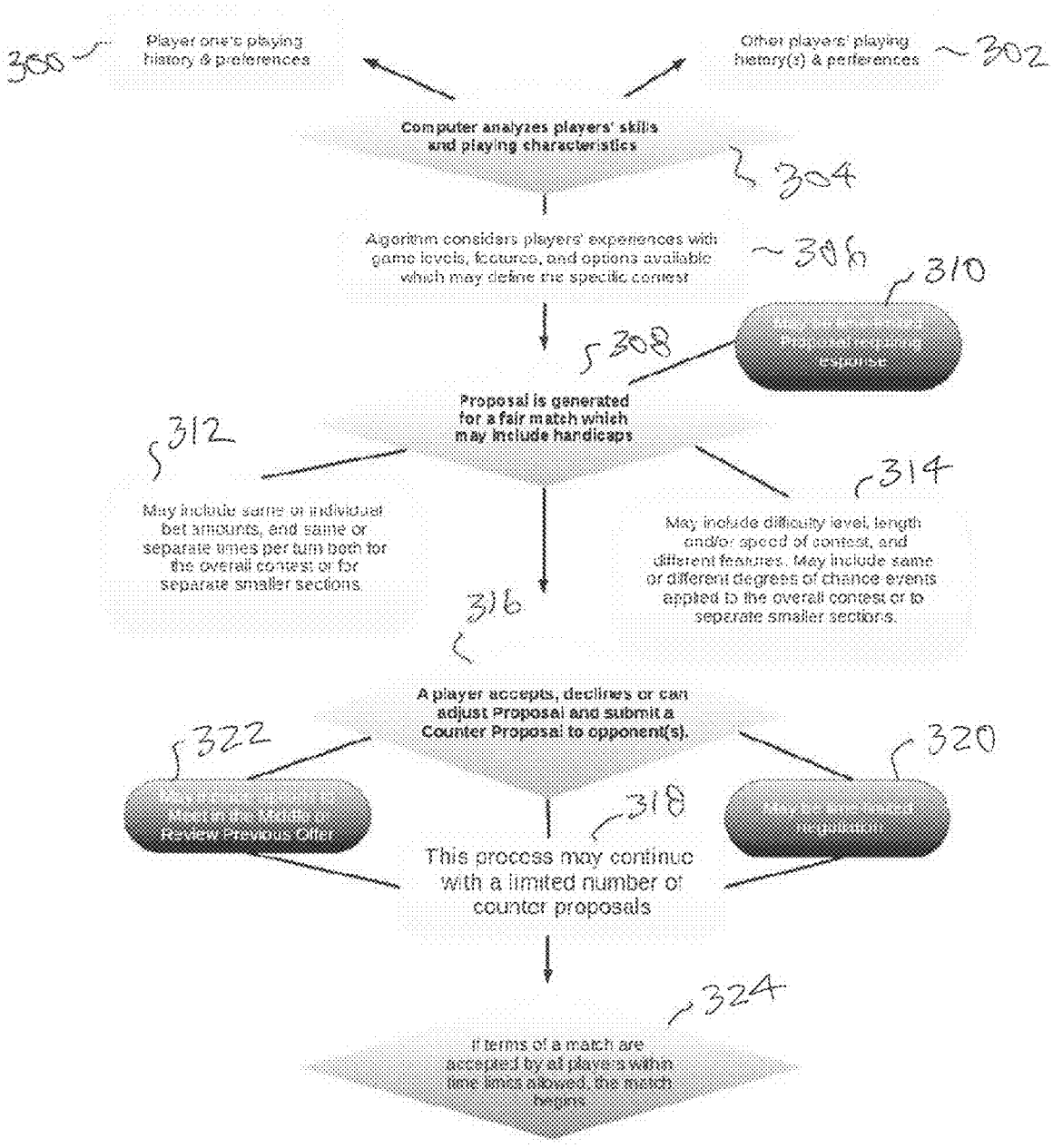

Fig. 46, Chance Element Methodology
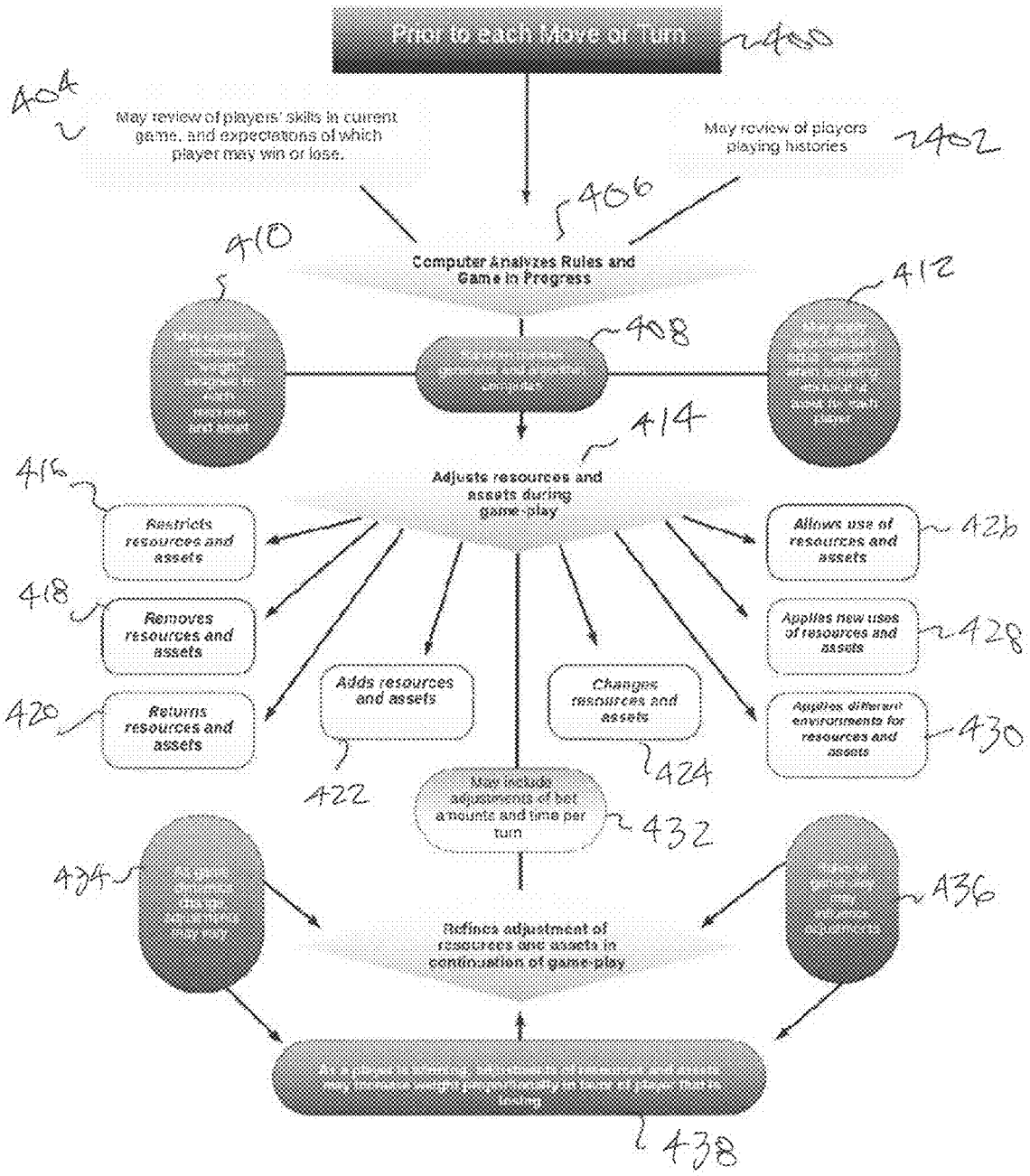

Fig. 46a, Application of Chance-Element Methodology to Poker
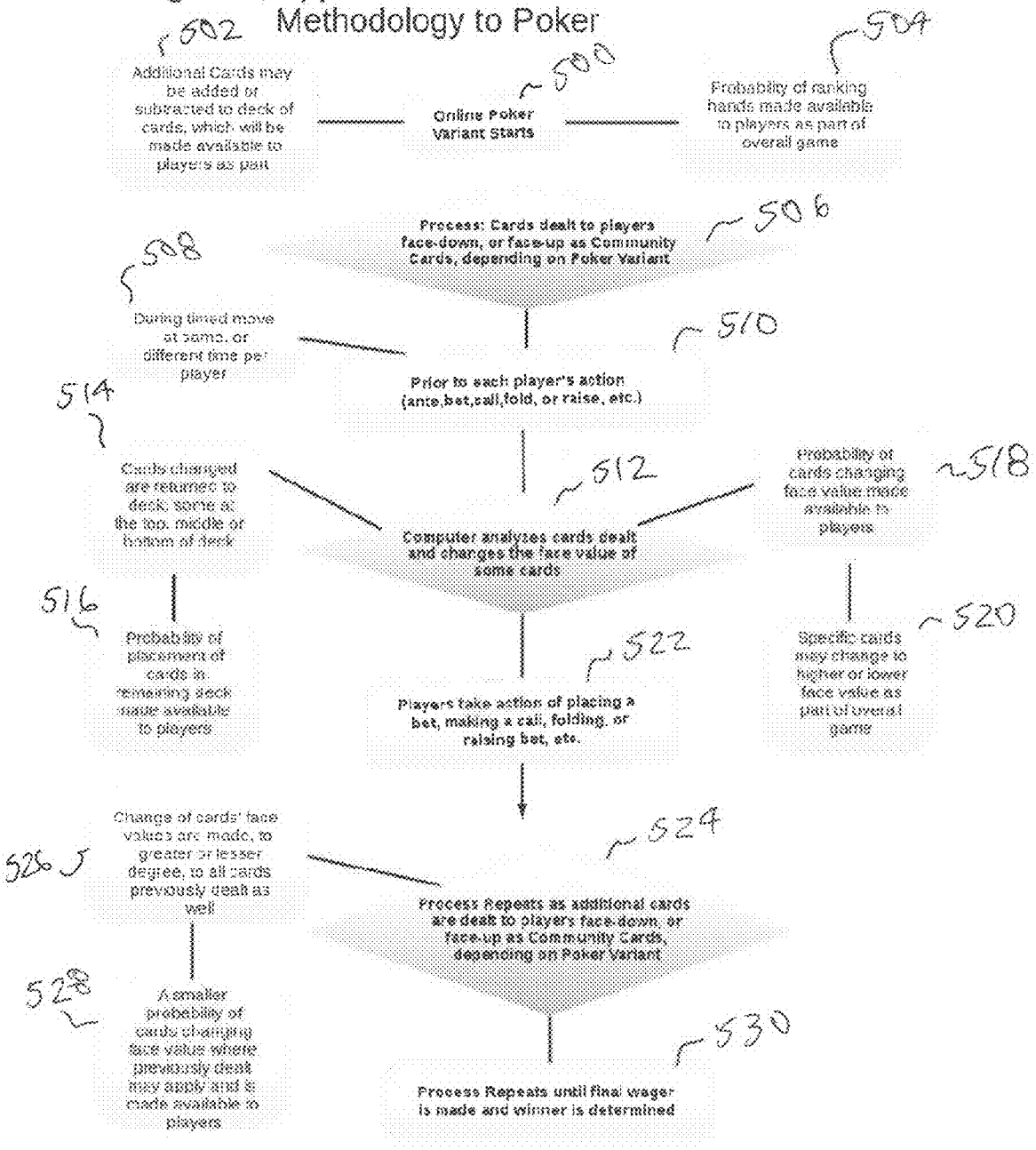

Fig. 46b, Application of Chance-Element Methodology to Chess
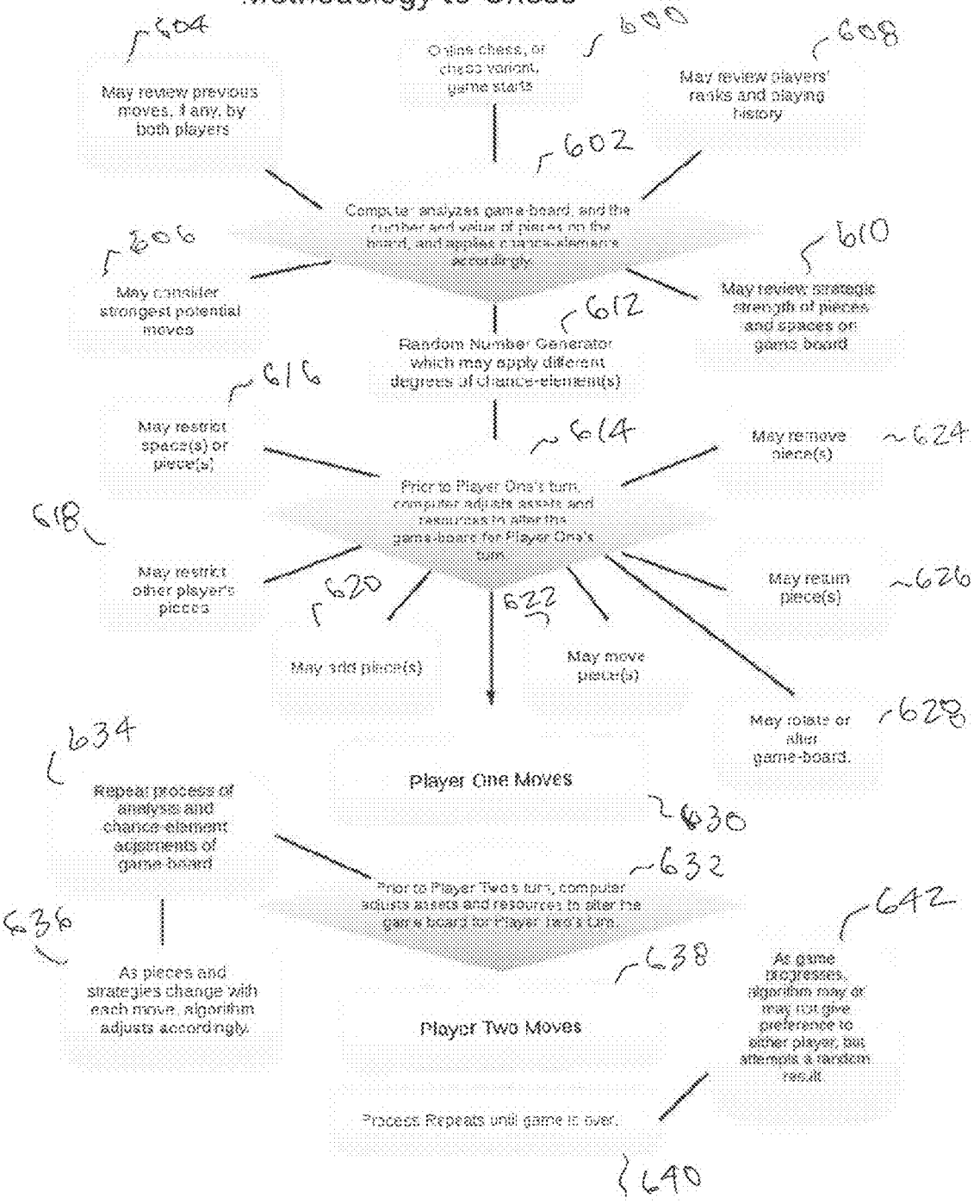

SYSTEM AND METHOD OF BET-MATCHING AND CHANCE-ELEMENT FEATURES FOR MULTI-PLAYER ONLINE SKILL GAMES

CROSS-REFERENCE TO RELATED APPLICATION

The application claims the benefit of U.S. Provisional Patent Application Ser. No. 61/922,362, filed Dec. 31, 2013, the disclosure of which is hereby incorporated by reference in its entirety for all purposes.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The present invention relates generally to the field of games or online gaming where games are played on computer browsers or downloaded apps on mobile devices, television, radio or other digital game boards, computing devices or electronic media. More particularly, the present invention relates to a system and method for bet-matching and chance-element features for online skill games where bets are placed between two or more players on the possible outcome of the skill game.

BACKGROUND OF THE INVENTION

The most popular skill games including board games and card games like poker and chess have been played for hundreds of years. The game of chess we know today has been around since the 15th century where it became popular in Europe. The game of chess is well known and the rules can be found in nearly every board game rule book, etc. Typically, the game of chess is a board game of strategic skill played between two opponents or players on a checkered board, of 8×8 squares. Each player begins the game with six different pieces (sixteen pieces in all): 1 king, 1 queen, 2 rooks, 2 bishops, 2 knights, and 8 pawns.

One of the players controls the white pieces and the other player controls the black pieces. The player who controls the white pieces makes the first move then the players take turns making moves. Pieces are moved to either an unoccupied square or one occupied by an opponent's piece, which is captured and removed from play. When a king is in a square under attack, it is said to be in check. A player may not make any move that would put or leave his or her king in check. A player cannot "pass"; at each turn, they have to make a legal move. The goal of the game is to put the opponent's king under a direct attack from which escape is impossible (i.e., checkmate). Checkmate happens when the king is in a position to be captured (in check) and cannot escape from capture.

In addition to checkmate, the game can be won by voluntary resignation by the opponent, which typically occurs when too many pieces are lost, or if checkmate appears unavoidable. A game may also result in a draw in several ways, where neither player wins, particularly in a stalemate (a draw) if that king is not under attack.

In chess, tactics in general concentrate on short-term actions—so short-term that they can be calculated in advance by a human player or by a computer. The possible depth of calculation depends on the player's ability. In quiet positions with many possibilities on both sides, a deep calculation is more difficult and may not be practical, while in "tactical" positions with a limited number of forced variations, strong players can calculate long sequences of moves. Strategies have been developed over the centuries and chess players often rely on memorization and follow a sequence of moves or repetition of patterns to play the game. Presently, there is a lack of betting options for real money gambling in chess games online primarily due to cheating typically by using software or bots.

Typically, poker is a family of several card games of skill in which a player bets that the value of his or her hand is greater than that of the hands held by others, in which each subsequent player must either equal or raise the bet or drop out, and in which the player holding the highest hand at the end of the betting wins the pot. The game of poker is well known and the rules can be found in nearly every card game rule book. In the game of poker, cards are dealt to each player. Players may have a chance to improve their hand by discarding some of their cards, and receiving replacements, as in draw poker, or more cards may be dealt than needed and the best cards retained, as in the seven-card variations of poker. Other forms like Texas Hold'em and Omaha requires the use of communal "board cards" that are shared by all players.

Various rounds of betting take place after dealing and after drawing. In five-card stud poker, one card is dealt face down and the four remaining cards are dealt face up one at a time with a round of betting after each face up card is dealt. In all variations of poker, when the betting rounds are completed, the remaining players expose their hands and the winning player collects the money bet. The outcome is determined by the combinations of cards in the exposed hands. Those combinations are well known—high card, one pair, two pair, three-of-a-kind, straight, flush, full house, four-of-a-kind, and straight flush—and are described in nearly every card game rule book.

For example, at least some known poker-type game such as, for example, "Texas Hold 'Em" provide each player two cards dealt face down from the common deck, after which five community cards are dealt face up from the common deck. Each player's hand is determined based on two, one or none of the player's dealt cards and three, four or all five of the five community cards. Betting rounds may occur after each player receives the two cards, after the third community card has been dealt (called the "flop"), after the fourth community card has been dealt (the "turn"), and after the fifth community card has been dealt (the "river"). In addition, antes and/or blinds may be required to bet a predefined fixed amount into a "pot" in order to participate in the round and prior to the cards being dealt. Any amount included in the "pot" may be distributed to the player having a winning card hand. During each betting round, each player may decide to remain in the round by placing and/or checking a bet or to leave the round by relinquishing any bets to the "pot" and "folding" their card hand. At the completion of each betting round, each of the remaining player displays the player's two dealt cards in a "showdown", and the value of each remaining player's hand is determined based on the player's two cards and three of the five community cards to form a five card poker hand, with the poker hands being ranked in standard poker fashion, such as, for example, royal flush, straight flush, four of a kind, full house, flush, straight, three of a kind, two pair, one pair, and high card, in descending order. The player having the highest poker hand is the game winner.

One disadvantage of the above-described skill games is that the players may have different skill levels, resulting in an unfair game. For example, identity and level of players are not transparent and there are not handicaps for advanced players. In addition, there is no way to adjust bet amounts and players cannot adjust the length of their turn. This results in an unfair game for the players. Another disadvantage of the above-described skill games is that online cheating is rampant. For example, online cheating by other players in collusion or with the use of or computer programs is common. Further, a computer program may be used to determine the odds of the games in poker, for example, and place large bets, or determine the skill levels of the players and play accordingly, thereby resulting in an unfair game.

It is, therefore, desirable to provide a new system and method that adjusts different settings of an online skill game to even the odds and facilitate a fair game. It is also desirable to provide a new system and method that limits the likelihood of online cheating by other players or computer programs. It is further desirable to provide a new system and method that facilitates online betting with a fairer matching of players of different skill levels and which eliminates, or greatly reduces, online cheating by other players or computer programs. Thus, there is a need in the art to provide a new system and method for bet-matching and chance-element for online skill games for two or more players that meet one or more of these desires.

In addition, there is a need in the art for new variations of popular skill games played online between more than one player that use new technology to match players of different skill levels with a system for handicaps relying less on memorization of habit but new variants with unique chance elements making the game more fair for online betting. Specifically, in this invention is a chess variant and poker application where the exemplified principals can be applied to other online skill games for multi-players.

SUMMARY OF THE INVENTION

The present invention is generally directed to systems and methods for bet-matching and chance-element features for online skill games where bets are placed between two or more players on the possible outcome of the skill game. The online skill games are played on computer browsers or downloaded apps on mobile devices, television, radio or other digital game boards, computing devices or electronic media. Two unique variants of popular skill games, with working titles of Chess-Clash and Poker Morph are included in the present invention and also illustrate use of the bet-matching and chance-element methodologies for poker and chess. As the present invention can be applied flexibly as methodologies, the sum of the present invention is also broader than its parts.

In one aspect of the present invention, a system for providing matching of bets in an online skill game to a plurality of players is provided. The system includes a display device for displaying the game, a computer coupled to the display device, the computer having memory for storing the game, and at least one controller coupled to the computer and the display device, the at least one controller being configured for allowing a playing history of a first player and a second player to be inputted into the computer. The computer is configured to analyze a skill level of the first player based on the playing history of the first player, to analyze a skill level of the second player based on the playing history of the second player, to generate an initial proposal for a fair match between the first player and the second player based on the analyzed skill levels, and to communicate the initial proposal to the controller of either one of the first player or the second player. Either the first player or the second player accepts or rejects the initial proposal by communicating the acceptance or rejection with the controller to the computer.

In another aspect of the present invention, a method for providing matching of bets in an online skill game to a plurality of players is provided. The method includes the steps of displaying the game with a display device, storing the game with a computer coupled to the display device, and inputting with at least one controller a playing history of a first player and a second player into the computer. The method also includes the steps of analyzing with the computer a skill level of the first player based on the playing history of the first player, analyzing with the computer a skill level of the second player based on the playing history of the second player, and generating with the computer an initial proposal for a fair match between the first player and the second player based on the analyzed skill levels. The method further includes the steps of communicating with the computer the initial proposal to the controller of either one of the first player or the second player and accepting or rejecting the initial proposal by either the first player or the second player and communicating the acceptance or rejection with the controller to the computer.

More particularly, one embodiment of the present invention provides a unique method of matching two or more players of different skill levels prior to playing any multi-player online skill game, based on a player's historical playing and analysis of game-specific measurements of skill. This methodology can include handicaps for the more advanced player(s), and a pre-game negotiation where players opposing one another adjust different settings of game features, time per turn or bet amounts, for example, to facilitate an agreement on a fair game for further ranking, and/or a bet of real or non-real currency on the outcome of the game.

A second embodiment of the present invention provides a unique method for utilizing the element of chance to vary any online skill game to limit online cheating and also to even the odds, or make the match fair when matching players of different skill levels. The resulting game, after the chance-element methodology has been applied systematically, can become a unique variation of the original skill game. In an embodiment of the present invention, the percentage applied of the chance-element methodology can be varied to a greater or lesser degree on one player's game versus the other, and set by the individual players in a pre-game negotiation.

A third and fourth embodiment of the present invention are two original variants of popular games, e.g., chess and poker. More particularly, these two unique game(s) or applications exemplify and can utilize both the bet-matching and chance-element methodologies. These two variants of popular skill games specifically vary the rules of the original games, add chance elements and facilitate online betting with a more fair matching of players of different skill levels with the added possibility of bet-matched and negotiated handicaps, and which eliminates, or greatly reduces, the likelihood of online cheating by other players or computer programs.

A fourth embodiment of the present invention provides a unique method of rotating same or different sized game-boards, courts, arenas, courses, tables, or physical orientation of a player or any place where the game is played, where the orientation of one or more pieces, cards, props, tools, materials, or physical space in which the game is played influences the outcome of any skill game because of the rotation. In an embodiment of the present invention, the manner of rotation can be varied to a greater or lesser effect on one player's game over the other, by the individual players in a pre-game negotiation.

A further embodiment of the present invention provides a unique method of presenting a board-game, card game or any game of skill as either one individual game or multiple individual games; where each individual game may have varying starting positions of its playing pieces, players, cards, props, tools or materials of the game and where the individual games become interchangeable subsets of a lengthier game. In an embodiment of the present invention, the number of smaller individual games which become interchangeable subsets of a lengthier game can be varied to a greater or lesser effect on one player's game over the other, by the individual players in a pre-game negotiation.

In another embodiment of the present invention, the game of chess can be played with methodology for analyzing skill levels of different players. More particularly, this methodology can help to match players of different skill levels and handicap the more advanced player when playing a less skilled player. In this embodiment, this methodology may also add an element of chance to the chess game to vary the game unexpectedly which can even-out the odds between players of different skill levels depending on luck of randomized occurrences.

Yet a further embodiment of the present invention provides at least one unique chess variant, with a working title of Chess-Clash, which includes new pieces with new rules of motion, and utilizes a pre-set group of different-sized game-boards each with a traditional checkerboard style of alternating colors, different starting positions of the pieces of each many different smaller games, which combine into a larger game, and where the different starting positions of each side "mirror" one another.

With regard to this embodiment of the present invention, and expanding the present rules of chess, is the inclusion of at least three new pieces including the Mage, the Archer, and the Gatekeeper, with new characteristic moves, and which can be added to the presence of standard chess pieces where at the beginning of each game, or shorter game called a Battle, or subset of an overall game, the pieces will vary to a greater of lesser degree in terms of the quantities and positions of each piece on the board.

A still further embodiment of the present invention provides a methodology for presenting the chess variant or game of skill where the overall game includes a collection of pre-set smaller or shorter games, called Battles, designed for the different game-board sizes. More particularly, the overall game can be played as a single Battle on a single game-board, or in combinations of Battles on the same or different game-boards which can form a larger composite game, or War. To lessen a player's reliance on habit and/or memorization, the Battles are served to players seemingly randomly but where a computer process keeps track of which Battles, and which rotations, have been played for a given player and, whenever possible, varies the presentation of the next Battle served to the players.

Another embodiment of the present invention provides a methodology for presenting the various Battles by rotating the different game-boards, and changing the orientation of which side the player's pieces are located. More particularly, and as a result of a game-board's rotation and change of which side of the board a player's pieces are located, is the changing direction of the Pawn; where its effectiveness is altered by a shift in direction or orientation.

Yet another embodiment of the present invention provides a unique methodology for analyzing skill levels of different players. More particularly, this methodology can help to match players of different skill levels and handicap the more advanced player when playing a less skilled player. In an embodiment, this method enables each player to tailor the parameters of the game, along with any financial bet being placed, through a series of counter-proposals which might include adjusting the amount of time each player has to make a move, the bet amounts being made and other settings prior to playing and betting on the outcome of the chess variant(s) or games of skill online or on mobile apps or other forms of digital media.

Still another embodiment of the present invention includes a methodology of adding an element of chance to chess, poker or any other game of skill to vary the game unexpectedly which can even-out the odds between players of different skill levels depending on luck of randomized occurrences. More particularly, the added element of chance can vary the use of the pieces, cards and other materials, tools, resources and game-specific techniques by restricting, removing, returning, adding, changing game specific resources, assets or techniques which are not presently done in chess, chess variants, poker or other games of skill to the extent of the present invention. This application of chance will minimize cheating by humans and/or computers by changing long term strategy randomly when the game is played online or when downloaded on mobile apps or on other forms of digital media.

Still yet another embodiment of the present invention includes an application of the chance-methodology in creating a unique variation of poker, with a working title of Poker Morph, which can be applied to all poker variants and other card games. While chance is part of poker in that cards are dealt without prior knowledge by the dealer or other players, this application of the chance-methodology both changes the probabilities, magnifies the skill required, evens the odds for players of different skill levels, and confounds the software robots as to what the odds are of having a winning hand.

More particularly in Poker Morph, the following high ranking cards are added to the deck: Jack, Queen, King and Ace of varying suits, which change suits randomly each new hand. Cards which are dealt are, to varying degrees and by chance, systematically transformed to other cards and returned into the remaining deck. This recycling of cards and added four cards above, gives players more information of what cards are still out in the deck and tends to result in higher hands, with a result that players will wait longer in the game prior to folding, placing large bets or bluffing and the overall effect of any poker variant is intensified.

One advantage of the present invention is that a new system and method is provided for matching players of different skill levels prior to playing any skill game such as chess, poker or other games of skill. Another advantage of the present invention is that the system and method of matching players of different skill levels enables two or more players to negotiate certain terms and pre-set parameters of the game. Yet another advantage of the present invention is that the system and method of matching players may result in handicaps for the more advanced players including varying the bet amount or time allotted per turn, making a competitive game and any financial bet on the outcome of that game, more fairly matched. Still another advantage of the present invention is that the system and method provides for adding a computer generated element of chance to determine which pieces, game features, cards, game assets, players' turns or other game resources can be used, removed, restricted, moved or changed in any way during the game, where the random elements change the normal rules of game play.

A further advantage of the present invention is that the system and method minimizes cheating by eliminating long term planning by computer software with unexpected chance events and/or to disrupt collusion or communication by two or more players which is common in online chess, poker or other games of skill when played online or on downloaded apps on mobile devices or other digital media.

Referring back to chess, yet a further advantage of the present invention is that the system and method may provide a skill game, for example based on the game of chess, and is a chess variant which uses the six standard chess pieces and many rules of the existing game with numerous and distinct differences. Still a further advantage of the present invention is that the system and method provides a new chess variant with at least three new pieces which have different rules of motion than traditional chess pieces and may be played on different-sized game-boards, which may rotate to switch overall position of the pieces and different sets of unique starting positions of the pieces, unlike chess.

Another advantage of the present invention is that the system and method provides an application of the chance-element methodology which can vary any card game and any variant of poker played online or in download apps or other digital media. Yet another advantage of the present invention is that the system and method provides systematic application of the chance-element methodology, with a working title, Poker Morph, with the addition of four cards (Jack, Queen, King and Ace) of varying suits added to the deck of cards initially which creates greater probabilities of a poker hand resulting in a flush, straight, straight-flush, royal flush and/or multiple cards of both higher and same faced value (which include a J, Q, K, and A). Still another advantage of the present invention is that the system and method provides, in the dealt hand, a percentage of cards that will transform, or morph, into a different and usually higher face-valued card during the timed-turn for each player.

A further advantage of the present invention is that the system and method provides characteristic transformation of cards that will affect both community cards which are dealt face-up and/or cards dealt to each player and face-down, and cards that are transformed are returned to the deck. Yet a further advantage of the present invention is that the system and method provides recycling of cards transformed that changes a player's calculation of probabilities and imparts a knowledge of what card(s) are "out" still and remain in the deck. Still a further advantage of the present invention is that the system and method provides published odds of random transformations of cards at different points in the game that are part of the rules of the game. Still yet a further advantage of the present invention is that the system and method provides a result that players will wait longer before folding or placing larger bets as they determine the odds of having a winning hand or the wisdom of bluffing.

Another advantage of the present invention is that the system and method provides both of these variants of popular skill games, in which the playing statistics of each player can be available for other players to review during a pre-game negotiation with players of different skill levels.

Yet another advantage of the present invention is that the system and method provides time per turn and bet amounts when relevant, including the ante, blinds, raise amounts and other standard game rules and practices, as part of a pre-game negotiation to even the odds between advanced and beginners.

Still another advantage of the present invention is that the system and method provides additional variations of chess, the new chess variant and poker application that can be offered to different groups of players that want to bet high amounts of money versus lower amounts, have versions with different means of scoring, or have faster games rather than slower games, for example.

Other features and advantages of the present invention will be readily appreciated, as the same becomes better understood, after reading the subsequent description taken in conjunction with the accompanying drawings.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified. FIGS. 1-42 relate to a unique chess variant, Chess-Clash, which is played both with the bet-matching and chance methodology, to greater or lesser degrees, and as referenced generally in FIGS. 45, 46, and 46*b* to be described.

FIG. 1 shows an example of a 4×5 square game-board, according to an embodiment of the present invention.

FIG. 2 shows an example of a 5×5 square game-board, according to an embodiment of the present invention.

FIG. 3 shows an example of a 5×6 square game-board, according to an embodiment of the present invention.

FIG. 4 shows an example of a 6×6 square game-board, according to an embodiment of the present invention.

FIG. 5 shows an example of a 6×7 square game-board, according to an embodiment of the present invention.

FIG. 6 shows an example of a 7×7 square game-board, according to an embodiment of the present invention.

FIG. 7 shows an example of a 7×8 square game-board, according to an embodiment of the present invention.

FIG. 8 shows an example of an 8×8 square game-board, according to an embodiment of the present invention.

FIG. 9 shows a unique design of a Pawn, according to an embodiment of the present invention.

FIG. 10 shows a unique design of a King, according to an embodiment of the present invention.

FIG. 11 shows a unique design of a Queen, according to an embodiment of the present invention.

FIG. 12 shows a unique design of a Bishop, according to an embodiment of the present invention.

FIG. 13 shows a unique design of a Rook, according to an embodiment of the present invention.

FIG. 14 shows a unique design of a Knight, according to an embodiment of the present invention.

FIG. 15 shows a unique and original design of a Mage, according to an embodiment of the present invention.

FIG. 16 shows a unique and original design of an Archer, according to an embodiment of the present invention.

FIG. 17 shows a unique and original design of a Gatekeeper, according to an embodiment of the present invention.

FIG. 18 is a flowchart illustrating the motions of a Mage, according to an embodiment of the present invention.

FIG. 19 is a flowchart illustrating the motions of an Archer, according to an embodiment of the present invention.

FIG. 20 is a flowchart illustrating the motions of a Gatekeeper, according to an embodiment of the present invention.

FIG. 21 is a flowchart illustrating the motions of a Pawn "Reborn", according to an embodiment of the present invention.

FIG. 22 is a flowchart illustrating the Definition of a War, according to an embodiment of the present invention.

FIG. 23 shows a sample Battle on a 6×6 square gameboard, according to an embodiment of the present invention.

FIG. 24 shows a sample Battle on a 5×6 square gameboard, according to an embodiment of the present invention.

FIG. 25 shows a sample Battle on a 4×5 square gameboard, according to an embodiment of the present invention.

FIG. 26 is a flowchart illustrating the Battle Order Shuffled and Varied, according to an embodiment of the present invention.

FIG. 27 shows the Battle of FIG. 23 at 0° position (play as white), according to an embodiment of the present invention.

FIG. 28 shows the Battle of FIG. 23 rotated 90° (play as white), according to an embodiment of the present invention.

FIG. 29 shows the Battle of FIG. 23 rotated 180° (play as white), according to an embodiment of the present invention.

FIG. 30 shows the Battle of FIG. 23 rotated 270° (play as white), according to an embodiment of the present invention.

FIG. 31 shows the Battle of FIG. 23 at 0° Switched Sides (play as black), according to an embodiment of the present invention.

FIG. 32 shows the Battle of FIG. 23 rotated 90° Switched Sides (play as black), according to an embodiment of the present invention.

FIG. 33 shows the Battle of FIG. 23 rotated 180° Switched Sides (play as black), according to an embodiment of the present invention.

FIG. 34 shows the Battle of FIG. 23 rotated 270° Switched Sides (play as black), according to an embodiment of the present invention.

FIG. 35 shows the Battle of FIG. 23 at 0° Ghost Mode (play as white), according to an embodiment of the present invention.

FIG. 36 shows the Battle of FIG. 23 rotated 90° Ghost Mode (play as white), according to an embodiment of the present invention.

FIG. 37 shows the Battle of FIG. 23 rotated 180° Ghost Mode (play as white), according to an embodiment of the present invention.

FIG. 38 shows the Battle of FIG. 23 rotated 270° Ghost Mode (play as white), according to an embodiment of the present invention.

FIG. 39 shows the Battle of FIG. 23 at 0° Ghost Mode (play as black), according to an embodiment of the present invention.

FIG. 40 shows the Battle of FIG. 23 rotated 90° Ghost Mode (play as black), according to an embodiment of the present invention.

FIG. 41 shows the Battle of FIG. 23 rotated 180° Ghost Mode (play as black), according to an embodiment of the present invention.

FIG. 42 shows the Battle of FIG. 23 rotated 270° Ghost Mode (play as black), according to an embodiment of the present invention.

FIG. 43 is a flowchart illustrating the combination of game-board sizes to form a Hybrid War, according to an embodiment of the present invention.

FIG. 44 is a flowchart illustrating the overall game as structured in different Levels, according to an embodiment of the present invention.

FIG. 45 is a flowchart illustrating the Bet-Matching Methodology with a negotiation between players prior to placing a bet, according to an embodiment of the present invention.

FIG. 46 is a flowchart illustrating the Chance Element Methodology that may be added to games of skill, according to an embodiment of the present invention.

FIG. **46*a*** is a flowchart illustrating the card game application, Poker Morph, when applied to the popular Poker variant, Texas Hold'em as an example, when utilizing the Chance Element Methodology, according to an embodiment of the present invention.

FIG. **46*b*** is a flowchart illustrating the chess game application, when applied to chess or chess variants, when utilizing the Chance Element Methodology, according to an embodiment of the present invention.

Figure 47:
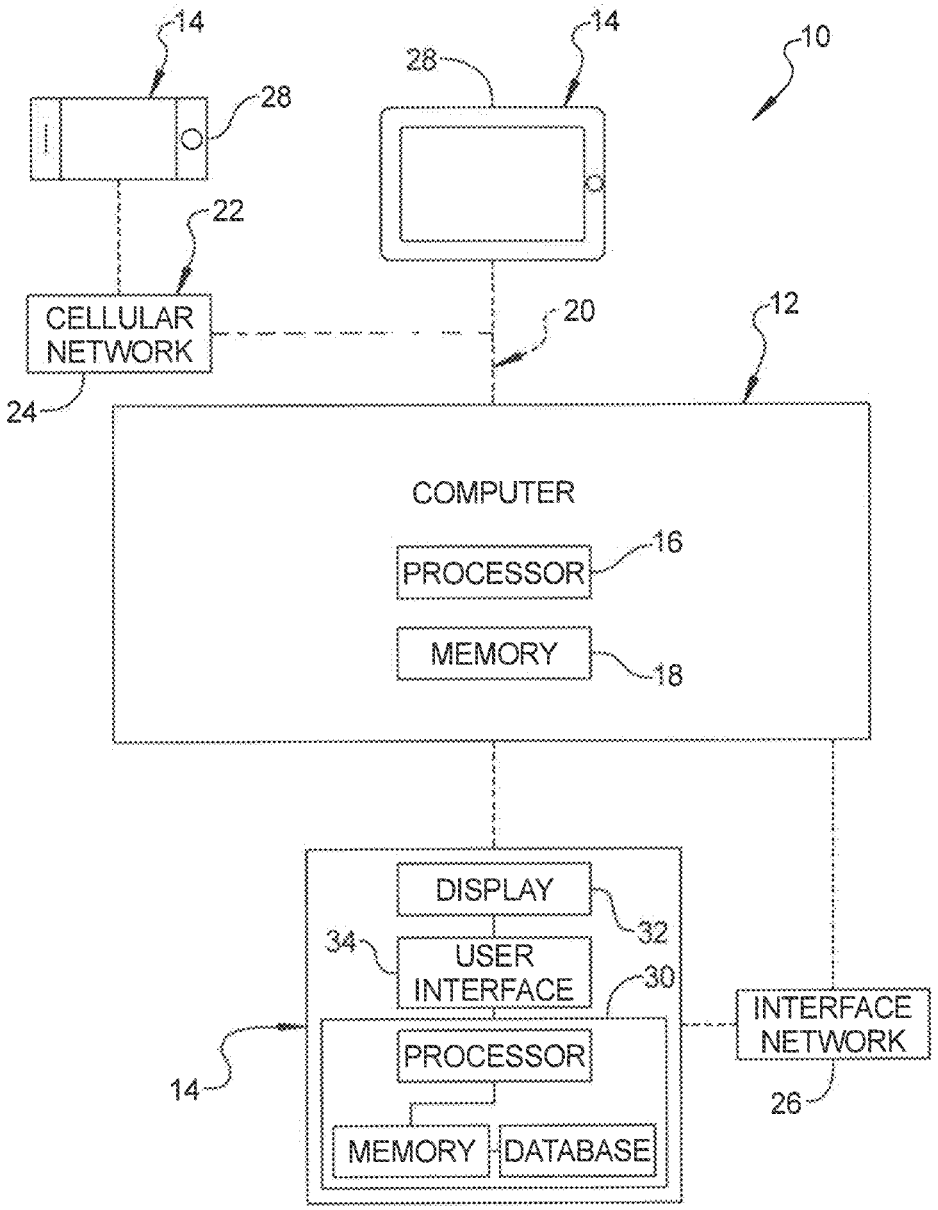

FIG. 47 is a schematic representation of an exemplary system for allowing a player to play an online skill game via a user computing device, according to an embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION OF THE PREFERRED EMBODIMENT(S)

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present invention may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible media of expression having computer-usable program code embodied in the media.

Any combination of one or more computer-usable or computer-readable media (or medium) may be utilized. For example, a computer-readable media may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

Embodiments may also be implemented in cloud computing environments. In this description and the following claims, "cloud computing" may be defined as a model for enabling ubiquitous, convenient, on-demand network access to a shared pool of configurable computing resources (e.g., networks, servers, storage, applications, and services) that can be rapidly provisioned via virtualization and released with minimal management effort or service provider interaction, and then scaled accordingly. A cloud model can be composed of various characteristics (e.g., on-demand self-service, broad network access, resource pooling, rapid elasticity, measured service, etc.), service models (e.g., Software as a Service ("SaaS"), Platform as a Service ("PaaS"), Infrastructure as a Service ("IaaS"), and deployment models (e.g., private cloud, community cloud, public cloud, hybrid cloud, etc.).

The flowchart and block diagrams in the flow diagrams illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable media that can direct a computer or other programmable data processing apparatus to function in a particular manner, such that the instructions stored in the computer-readable media produce an article of manufacture including instruction means which implement the function/act specified in the flowchart and/or block diagram block or blocks.

Several (or different) elements discussed below, and/or claimed, are described as being "coupled", "in communication with", or "configured to be in communication with". This terminology is intended to be non-limiting, and where appropriate, be interpreted to include without limitation, wired and wireless communication using any one or a plurality of a suitable protocols, as well as communication methods that are constantly maintained, are made on a periodic basis, and/or made or initiated on an as needed basis.

The disclosure particularly describes how multiple players play a game of skill such as chess or poker and matches two or more players of different skill levels prior to playing any multi-player skill game, based on a player's historical playing and analysis of game-specific measurements of skill. The disclosure also describes how to utilize the element of chance to vary any game of skill to limit online cheating and also to even the odds, or make the match fair when matching players of different skill levels. The disclosure further describes how two original variants of popular games, e.g., chess and poker, and other variants and applications, can utilize both the bet-matching and chance-element methodologies.

With reference to the Figs. and in operation, the present invention provides a system 10, methods and computer product media that facilitate bet-matching and chance-element in an online skill game where bets are placed between two or more players on the possible outcome of the skill game. It should be appreciated that the online skill games are played on computer browsers or downloaded apps on mobile devices, television, radio or other digital game boards, computing devices or electronic media.

Referring to FIG. 47, an exemplary environment in which the system 10 provides for matching of bets and elements of chance in an online game of skill to a plurality of players, according to an embodiment of the present invention, is illustrated. In the illustrated embodiment, the system 10 includes a computer, generally indicated at 12, that is coupled to one or more user computing devices, generally indicated at 14, to allow a plurality of players to simultaneously participate in an online game. The computer 12 may include a processor 16, memory 18, a display (not shown), and a user input mechanism (not shown) and may be in the form of a "server system". The computer 12 may also include a database for storing information or be coupled to a database to access information. The computer 12 is configured to carry out the methodologies to be subsequently described. It should be appreciated that the computer 12 may be programmed in a suitable language to carry out the methodologies to be subsequently described.

Each user computing device 14 is configured to transmit and receive data to and/or from the computer 12 to display a game and graphical interfaces (shown in FIGS. 23-25 and FIGS. 27-42) to enable a user to participate in "player vs. player" skill-type games with the user computing device 14. In the illustrated embodiment, the computer 12 is coupled to each user computing device 14 via a communications link, generally indicated at 20 and in dotted lines, that enables each user computing device 14 to access the computer 12 over a network, generally indicated at 22, such as, for example, the Internet 24, a cellular telecommunications network 26, a wireless network and/or any suitable telecommunication network that enables the user computing devices 14 to access the computer 12. For example, in one embodiment, the user computing device 14 includes a mobile computing device 28, e.g., a Smartphone that communicates with the computer 12 via the cellular telecommunications network 26 and/or the Internet 24. In another embodiment, the user computing device 14 may include a personal computer, laptop, cell phone, tablet computer, Smartphone/ tablet computer hybrid, personal/home video game device, personal data assistant, and/or any suitable computing device that enables a user to connect to the computer 12 and display the graphical interfaces.

In the illustrated embodiment, each user computing device 14 includes a controller 30 that is coupled to a display device 32 and a user input device 34. The controller 30 receives and transmits information to and from the computer 12 and displays the game and the graphical interfaces (shown in FIGS. 23-25 and FIGS. 27-42) on the display device 32 to enable the user to interact with the computer 12 to play the games in accordance with the embodiments described herein. The display device 32 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 34 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 30 and/or to retrieve data from the controller 30. It should be appreciated that a single component, such as a touch screen, a capacitive touch screen, and/or a touchless screen, may function as both the display device 32 and as the user input device 34.

For clarity in discussing the various functions of the system 10, multiple computers and/or servers are discussed as performing different functions. These different computers (or servers) may, however, be implemented in multiple different ways such as modules within a single computer, as nodes of a computer system, etc. . . . . The functions performed by the system 10 (or nodes or modules) may be centralized or distributed in any suitable manner across the system 10 and its components, regardless of the location of specific hardware. Furthermore, specific components of the system 10 may be referenced using functional terminology in their names. The function terminology is used solely for purposes of naming convention and to distinguish one element from another in the following discussion. Unless otherwise specified, the name of an element conveys no specific functionality to the element or component. It should be appreciated that, in selected embodiments, the software, hardware, and associated components of the system 10 may be programmed and configured to implement one or more embodiments described herein. It should also be appreciated that the various aspects of the system 10 may be exemplified as software, modules, nodes, etc. of a computer or server.

Before describing the bet-matching and chance-element features of the present invention which can be applied to all online games of skill, the following description will focus first on a chess variant known as Chess-Clash, which can incorporate the bet-matching and chance-element features to be described in connection with FIGS. 45 and 46.

Figure 1:
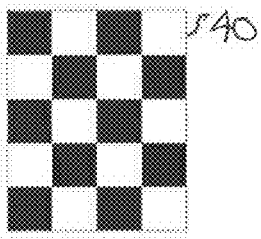

Game-Boards for Chess-Clash:

Referring now to FIG. 1, a four-square by five-square game-board 40 is shown which may be populated by up to twenty pieces which may include pieces 42, 44, 46, 48, 50, 52, 54, 56, and 58, shown in FIGS. 9-17. One embodiment of the present invention is to play one or more smaller games or, Battles, on this game-board size, where each Battle has different starting positions for the overall collection of pieces, including some or all of pieces 42-58, where each side "mirrors" the other, and where each game-board size has multiple Battles created for that size game-board 40.

Figure 2:
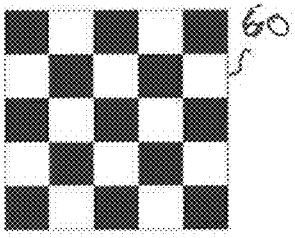

Referring now to FIG. 2, a five-square by five-square game-board 60 is shown which may be populated by up to twenty five pieces which may include pieces 42-58, shown in FIGS. 9-17. One embodiment of the present invention is to play one or more Battles on this game-board size, where each Battle has different starting positions for the overall collection of pieces 42-58, where each side "mirrors" the other, and where each game-board size has multiple Battles created for that size game-board 60.

Figure 3:
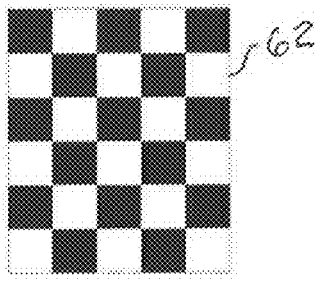

Referring now to FIG. 3, a five-square by six-square game-board 62 is shown which may be populated by up to thirty pieces which may include 42-58, shown in FIGS. 9-17. One embodiment of the present invention is to play one or more Battles on this game-board size, where each Battle has different starting positions for the overall collection of pieces 42-58, where each side "mirrors" the other, and where each game-board size has multiple Battles created for that size game-board 62.

Figure 4:
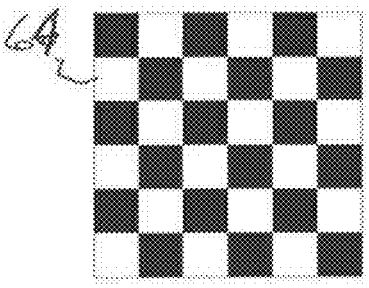

Referring now to FIG. 4, a six-square by six-square game-board 64 is shown which may be populated by up to thirty six pieces including those pieces 42-58, shown in FIGS. 9-17. One embodiment of the present invention is to play one or more Battles on this game-board size, where each Battle has different starting positions for the overall collection of pieces 42-58, where each side "mirrors" the other, and where each game-board size has multiple Battles created for that size game-board 64.

Figure 5:
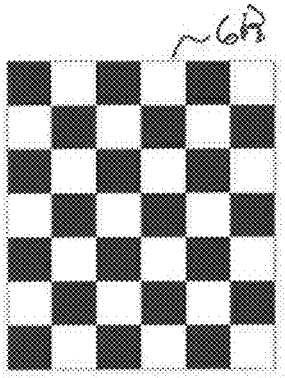

Referring now to FIG. 5, a six-square by seven-square game-board 66 is shown which may be populated by up to forty two pieces including those pieces 42-58, shown in FIGS. 9-17. One embodiment of the present invention is to play one or more Battles on this game-board size, where each Battle has different starting positions for the overall collection of pieces 42-58, where each side "mirrors" the other, and where each game-board size has multiple Battles created for that size game-board 66.

Figure 6:
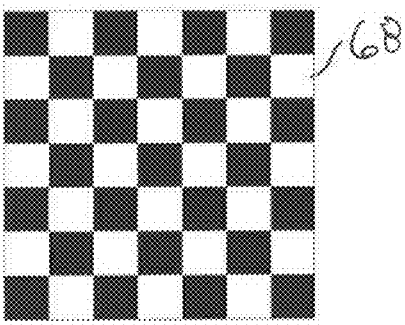

Referring now to FIG. 6, a seven-square by seven-square game-board 68 is shown which may be populated by up to forty nine pieces including those pieces 42-58, shown in FIGS. 9-17. One embodiment of the present invention is to play one or more Battles on this game-board size, where each Battle has different starting positions for the overall collection of pieces 42-58, where each side "mirrors" the other, and where each game-board size has multiple Battles created for that size game-board 68.

Figure 7:
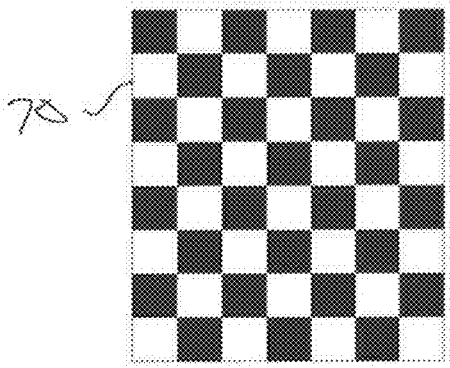

Referring now to FIG. 7, a seven-square by eight-square game-board 70 is shown which may be populated by up to fifty six pieces including those pieces 42-58, shown in FIGS. 9-17 and/or other pieces. One embodiment of the present invention is to play one or more Battles on this game-board size, where each Battle has different starting positions for the overall collection of pieces 42-58, where each side "mirrors" the other, and where each game-board size has multiple Battles created for that size game-board 70.

Figure 8:
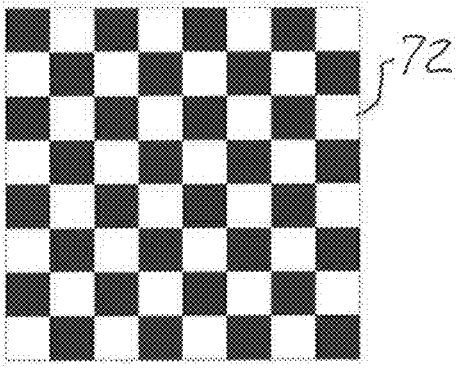
Figure 15:
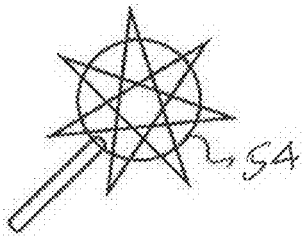
Figure 16:
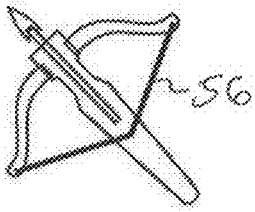
Figure 17:
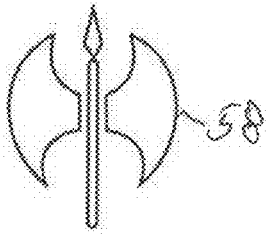

Referring now to FIG. 8, an eight-square by eight-square game-board 72 is shown which may be populated by up to sixty four pieces including those pieces 42-58, shown in FIGS. 9-17 and/or other pieces. One embodiment of the present invention is to play one or more Battles on this game-board size, where each Battle has different starting positions for the overall collection of pieces, where each side "mirrors" the other, and where each game-board size has multiple Battles created for that size game-board 72. It should be appreciated that pieces 42, 44, 46, 48, 50, and 52, shown in FIGS. 9-14, represent a Pawn, King, Queen, Bishop, Rook or Castle, and Knight, respectively, in a conventional Chess skill game. It should also be appreciated that pieces 54, 56, and 58, shown in FIGS. 15-17, represent new pieces to be described for use in the Chess-Clash skill game.

Figure 18:
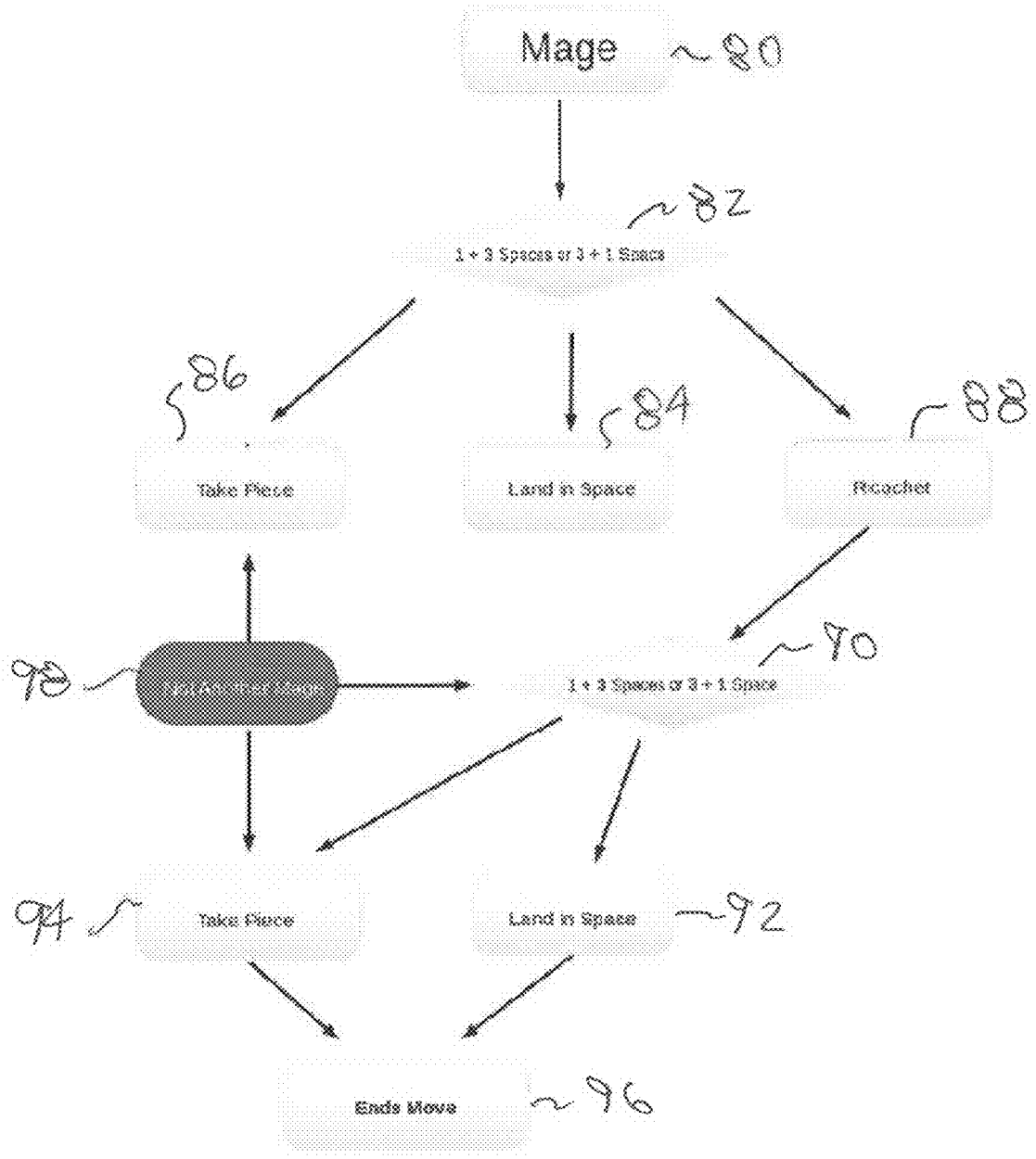

Mage:

Referring now to FIG. 15, one of the elements of the present invention is the piece 54 that is named the "Mage". A flowchart of the motions for the Mage is illustrated in FIG. 18. The Mage is shown in block 80. One of the basic rules of motion for the Mage is that it can leap three plus one spaces (3+1) or one plus three spaces (1+3) at a time in any direction as shown in block 82 while leaping over any piece or space in between and land on an empty space as shown in block 84 to complete its move.

Referring now to FIG. 18, another rule of motion available to the Mage is that it can leap three plus one spaces, or one plus three spaces at a time in any direction while leaping over any piece or space in between and take an opponent's piece as shown in block 86 to complete its move.

Referring again to FIG. 18, yet another rule of motion available to the Mage is that it can leap three plus one spaces or one plus three spaces, at a time in any direction while leaping over any piece or space in between and ricochet off a like-colored piece as shown in block 88. After the Mage ricochets of a like-colored piece, it can again leap three plus one spaces, or one plus three spaces, in any other direction as shown in block 90 while leaping over any piece or space in between and, finally, either land in an empty space as shown in block 92 or take an opponent's piece as shown in block 94 to complete its move. The Mage ends its move as shown in block 96. It should be appreciated that, in one embodiment of the present invention, the Mage may not take the opposing side's Mage and vice versa as shown in block 98.

Figure 19:
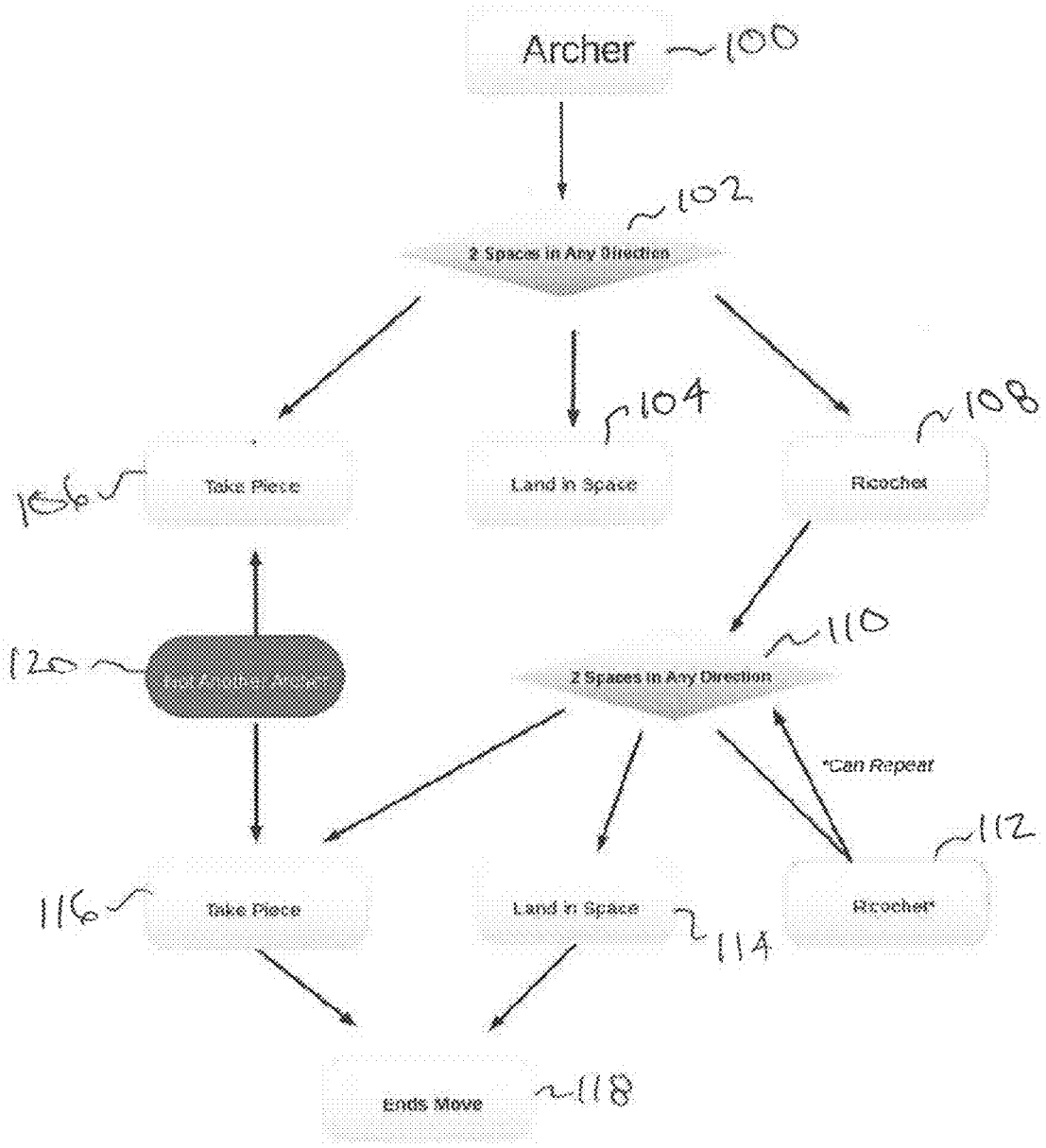

Archer:

Referring to FIG. 16, one of the elements of the present invention is the piece 56 that is named the Archer. A flowchart of the motions for the Archer is illustrated in FIG. 19. The Archer is shown in block 100. One of the basic rules of motion for the Archer is that it can leap by two (2+2+2, etc.) spaces at a time in any direction as shown in block 102, while leaping over any piece or space in between and land in an empty space as shown in block 104 to complete its move.

Referring now to FIG. 19, another rule of motion available for the Archer is that it can leap two spaces at a time in any direction while leaping over any piece or space in between and take an opponent's piece as shown in block 106 while landing in that space to complete its move.

Referring again to FIG. 19, yet another rule of motion available for the Archer is that it can leap two spaces at a time in any direction, while leaping over any piece or space in between and ricochet off a like-colored piece as shown in block 108. After the Archer ricochets off a like-colored piece, it can then leap two spaces in any other direction as shown in block 110 while leaping over any piece or space in between, and repeat this motion in any combination of successive ricochets as shown in block 112 and finally either land in an empty space as shown in block 114 or take an opponent's piece as shown in block 116 to complete its move.

Referring yet again to FIG. 19, still another rule of motion for the Archer is that it can leap two spaces at a time in any direction, while leaping over any piece or space in between, and take an opponent's piece, then leap two spaces in any other direction while leaping over any piece or space in between and take another opponent's piece, and repeat this motion and the taking of additional opponent's piece(s) but then land in the space of the last piece taken to complete its move.

Referring now to FIG. 19, another rule of motion for the Archer is that it can leap two spaces at a time in any direction and make as many successive ricochets as desired before either taking one or more of the opponent's pieces (where each is two spaces apart), while leaping over any piece or space in between, and then either land in the space of the opponent's last piece taken or land in an empty space to complete its move.

Referring again to FIG. 19, yet another rule of motion available to the Archer is that after leaping two spaces in any direction while leaping over any piece or space in between, and after one ricochet or a succession of ricochets, it may uncharacteristically move by just one space in any direction and land in an adjacent empty space to complete its move. This move, which may be called a "Shift," is typically made to reposition the Archer so it is in a better position for future moves. The Archer ends its move as shown in block 118. It should be appreciated that, in one embodiment of the present invention, the Archer may not take the opposing side's Archer and vice versa as shown in block 120.

Figure 20:
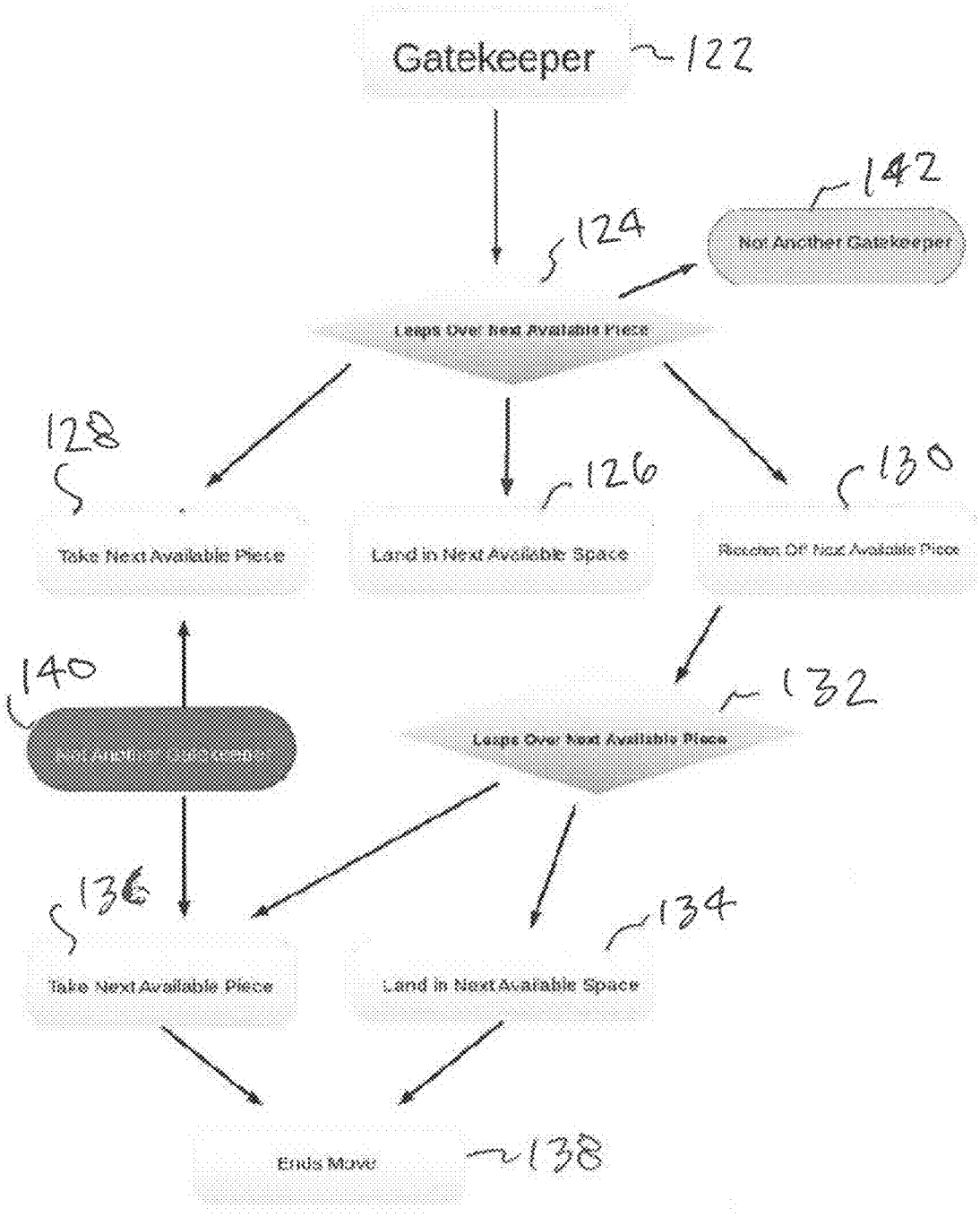

Gatekeeper:

Referring now to FIG. 17, one of the elements of the present invention is the piece 58 that is named the Gatekeeper. A flowchart of the motion of the Gatekeeper is illustrated in FIG. 20. The Gatekeeper is shown in block 122. One of the basic rules of motion for the Gatekeeper is that it can leap (Leap over Next Available Piece and "Land") over the next available piece as shown in block 124 of any color in a straight direction, not diagonally, while leaping over any piece in between, and land in the next available space as shown in block 126 to complete that move.

Referring to FIG. 20, another rule of motion available to the Gatekeeper is that it can leap (Leap over Next Available Piece and "Take") over the next available piece of any color in a straight direction, not diagonally, and continue the leap over any number of empty spaces or pieces of like-color and take the next available opponent's piece as shown in block 128 and land in that space to complete its move.

Referring now to FIG. 20, yet another rule of motion available to the Gatekeeper is that it can leap (Leap over Next Available Piece and "Ricochet") over the next available piece of any color in a straight direction, not diagonally, and continue the leap over any number of empty spaces or pieces of opposite color and make the next available ricochet off a piece of like-color as shown in block 130. After the Gatekeeper ricochets off a like-colored piece, it can then make a ninety degree (90°) turn to either side, and leap over the next available piece as shown in block 132 of any color and land in the next available space as shown in block 134 to complete that move.

Referring again to FIG. 20, still another rule of motion available to the Gatekeeper is that it can leap over the next available piece of any color in a straight direction, not diagonally, and continue the leap over any number of empty spaces or pieces of opposite color and make the next available ricochet off a piece of like-color. After the Gatekeeper ricochets off alike colored piece, it can then make a ninety degree (90°) turn to either side, and leap over the next available piece of any color and continue the leap over any number of empty spaces or pieces of like-color and take the next available opponent's piece as shown in block 136 and land in that space to complete that move. The Gatekeeper ends its move in block 138. It should be appreciated that, in one embodiment of the present invention, the Gatekeeper may not take the opposing side's Gatekeeper and vice versa as shown in block 140. It should also be appreciated that, more particularly, no Gatekeeper may leap over another Gatekeeper as shown in block 142.

Figure 21:
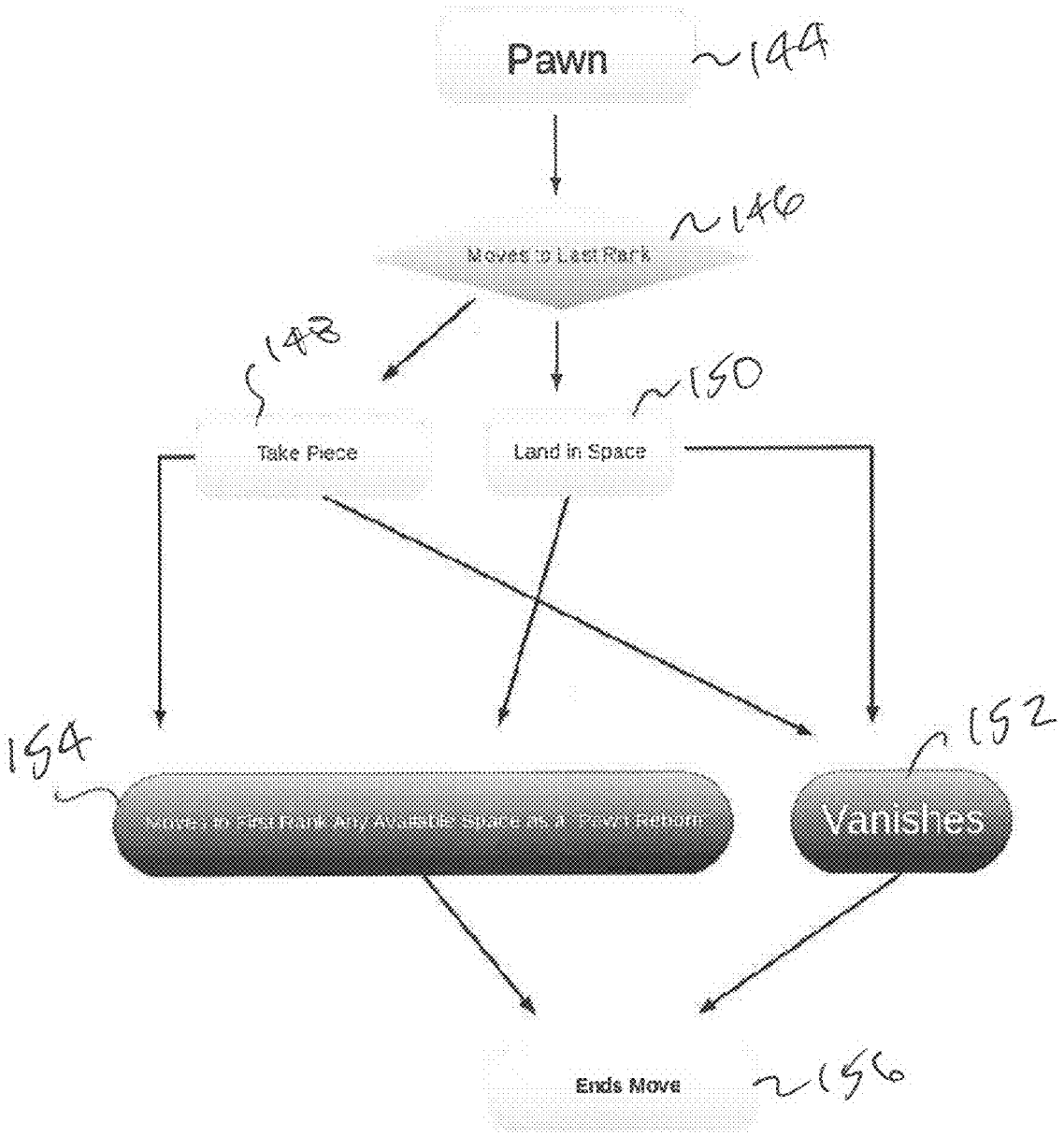

Pawn Reborn:

Referring to FIG. 21, the Pawn is shown in block 144. One of the elements of the present invention is a move available to a Pawn when the Pawn reaches the far rank of the game-board 40 and 60-72 as shown in block 146. The Pawn can take a piece 42-58 as shown in block 148 or land in a space as shown in block 150. The Pawn can either "Vanish" as shown in block 152 and be retired from the game permanently or, if there is an empty space on its very first rank of the game-board 40 and 60-72, it can move to any of the empty space(s) available in that first rank and is said to be a "Pawn Reborn" as it can start over again from its first rank.

Figure 9:
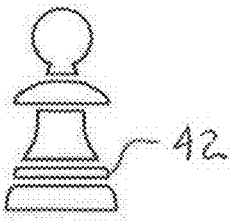
Figure 10:
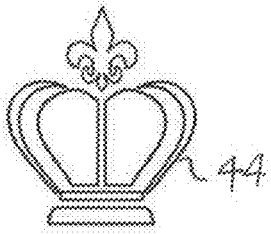
Figure 11:
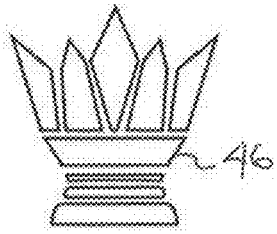
Figure 12:
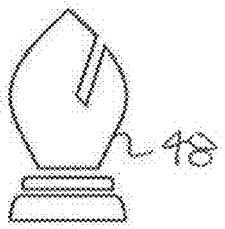
Figure 13:
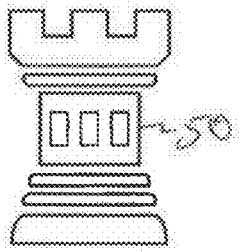
Figure 14:
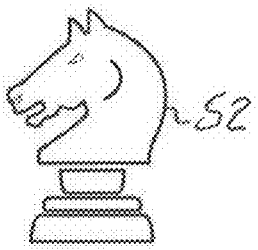

Referring again to FIG. 21, one of the elements of the present invention is a move available to a Pawn where if a Pawn's starting position is already in the last rank and it does not have a move to make otherwise, it is said to be in a "Dormant Pawn-Reborn" status. Should a different Pawn of same color reach that same last rank, the "Dormant Pawn-Reborn" can either "Vanish" and be retired permanently from the game or, if there is an empty space on its first rank of the game-board, it can move to any of the empty space(s) available in that first rank and is said to be a "Pawn Reborn" as shown in block 154 as it can start over again from its first rank. The Pawn ends its move as shown in block 156. It should be appreciated that the piece 42 illustrated in FIG. 9 is the Pawn.

Other Rules:

In one embodiment of the present invention, the rules are similar to chess when moving the standard six chess pieces 42-52 with at least the following exceptions:

- there is no "check," and therefore one can move while technically "in check";
- there is no "check-mate," but one must take the last King to win the game;
- the first player to have only three pieces remaining is automatically "Challenged" by their opponent, and must win in two moves or "Surrender";
- there is no "stale-mate," but the first player to move up to ten times without taking another piece automatically loses that Battle;
- there is no "castling" between King and Rook;
- there is no "promotion" of a Pawn to another piece when reaching its last rank but the new Pawn Reborn rules apply;
- there is a Pawn Direction*1 Indicator to guide each player as the Pawn shifts direction when the board 40 and 60-72 rotates, the Sides are Switched, or when played in Ghost Mode;
- if a player does not make a move within the time allotted*2, that player times-out;
- each player may be allowed a number of "Passes*3" within each Battle;
- the least-experienced player goes first, but that right may be negotiated in a pre-game period of negotiation; after the first move, the right to go first for each move can alternate between the two players;
- moves are timed when the game is ranked, with a ten (10) second warning;
- a Surrender button allows a player to forfeit a Battle and go automatically to the next Battle if part of a War; and
- an alert prompts a player to complete a Move initiated, by clicking the Submit button and/or the Ricochet button when required.

*1. To vary the physical and visual presentation of a Battle's starting positions, the board 40 and 60-72 will rotate, a player's side will switch, or a Battle will be played in Ghost Mode, and the Pawn's Direction will change. A Pawn Direction Indicator reminds the player of the direction their Pawn moves in.

*2. In one embodiment of the present invention, each move is timed, and in this timed-move environment, the skill level of the player is quantified and tracked.

*3. In one embodiment of the present invention, there is a "Pass" button with a Use-limit per Battle where a player can skip their turn for strategic reasons, or because they do not want to be timed-out.

Rank Points:

In one embodiment of the present invention, "Rank Points" or skill points are awarded in varying amounts to each player based on one or more measureable skill demonstrated. Rank Point details can be available for other players to review prior to challenging or placing bets on the outcome of a game. Moves that will be awarded with Rank Points in this chess variant may include:

- a "setup" by any piece where it can be a point of ricochet for one of the new pieces 54-58 from which a King can be taken in the next move;
- a "setup" by any piece where it can be a point of ricochet for one of the new pieces 54-58 where the new piece 54-58 can become a "next available piece" or a point of ricochet for a Gatekeeper's move where it either takes a King or a new piece 54-58;
- use of one of the new pieces 54-58 in the taking of a King;
- the taking of a Mage;
- the blocking of a potential move by one of the new pieces 54-58 by any piece which otherwise could have resulted in that new piece 54-58 taking a King;
- creating a "fork" where any piece may take either a new piece 54-58 or a King in the next move;
- the taking of a new piece 54-58 by another new piece 54-58, when it is a legal move;
- a "sleight of hand" where the move of one of the new pieces 54-58 both takes a piece and sets itself up at the same time to take a King in the next move;
- a "sleight of hand" when the move of any piece sets up a new piece 54-58 to take either a King or one of the new pieces 54-58 in the next move;
- a "double-sleight of hand" where the move of one of the new pieces 54-58 takes a piece and sets itself up as a "next available piece" for the Gatekeeper where it can take a King or a Mage;
- a "double-sleight of hand" where the move of one of the new pieces 54-58 takes a piece, and sets itself up to take both a King or a Mage in the next move;
- a "double-sleight of hand" where the move of one of the new pieces 54-58 takes a piece, and sets itself up to be a point of ricochet for a new piece 54-58 to take both a King or a Mage in the next move;
- a "double-sleight of hand" when the move of a new piece 54-58 sets up itself in a "fork" where it can take one of two Kings in the next move;
- a "triple-sleight of hand" when the move of a new piece 54-58 both takes a piece and sets up itself in a "fork" where it can take one of two Kings in the next move;
- the use of the Gatekeeper to block a move by the opposing side's Gate-Keeper which could otherwise have taken a King;

the use of a King to take one of the new pieces 54-58;

the use of a King to set itself up as a point of ricochet for one of the new pieces 54-58 so that new piece 54-58 can take the opposing side's King or a Mage;

the use of the Archer to take more than four pieces in one move;

the use of the Pawn Reborn move;

the use of one of the new pieces 54-58 to "pin" a King;

the use of the Pawn Reborn move to "pin" a King or one of the new pieces 54-58; and the use of the Dormant Pawn Reborn move.

Figure 22:
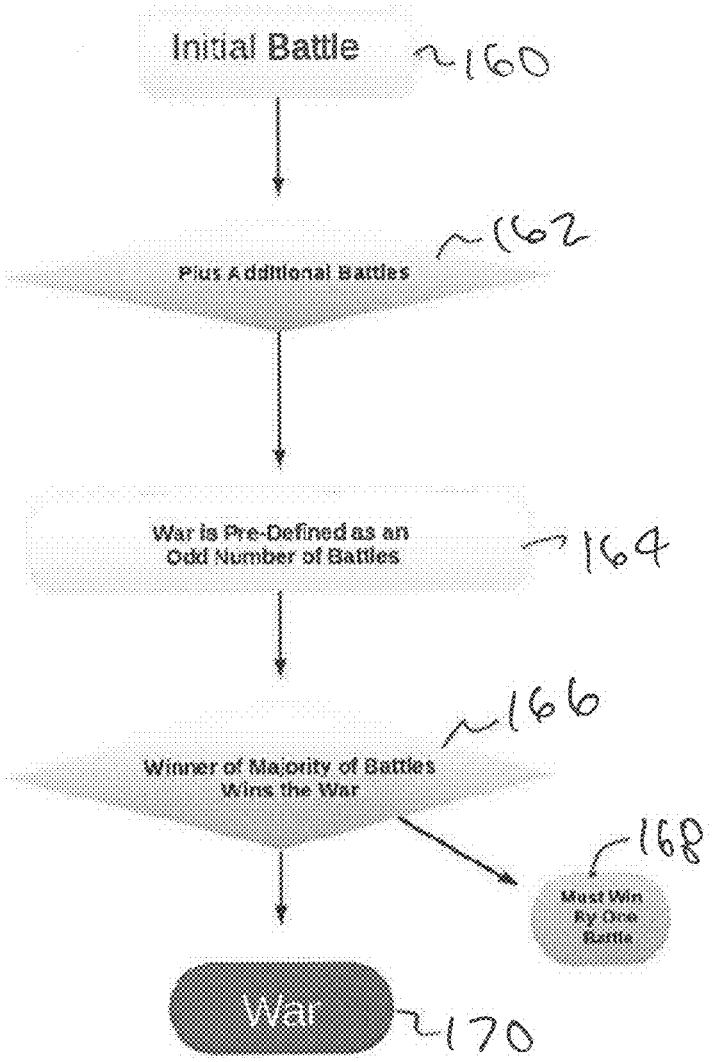

Battles and Starting Positions:

Referring now to the flowchart in FIG. 22, the illustration shows that the game may be played as a single Battle or as a combination of Battles from either the same sized board 40 and/or 60-72, or different sized game-boards 40 and/or 60-72, and thereby constitute the playing of an overall War. The Initial Battle is shown in block 160 and there may be additional Battles as shown in block 162. Furthermore, the War is pre-defined as an odd-number of Battles as shown in block 164, where the player that wins the majority of Battles as shown in block 166 must win by one Battle as shown in block 168 to win the War as shown in block 170.

Figure 23:
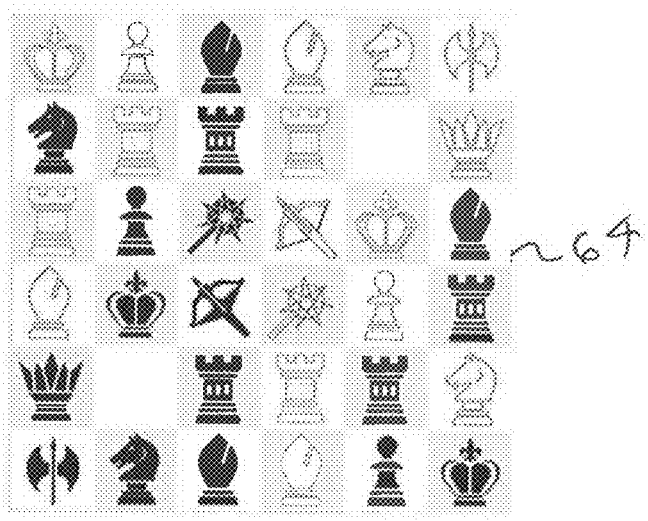

Referring now to FIG. 23, and where in this embodiment of the invention there is a sample illustration of a single Battle on a 6×6 square game-board 60, with unique starting positions. In the overall chess variant, there exists as many as eighty-eight regulation Battles of which FIG. 23 is one sample. Each single Battle has different starting positions where the two opponent's pieces mirror one another, symmetrically, and this aspect is the same for every Battle created for each of the different game-board sizes 40 and/or 60-72 shown in FIGS. 1-8.

Referring again to FIG. 23, and in this specific Battle, each opposing side has 2 Pawns, 4 Rooks, 3 Bishops, 2 Knights, 2 Kings 1 Queen, 1 Mage, 1 Archer, 1 Gatekeeper, and there are 2 empty spaces per side. The number of each of these pieces and empty spaces will vary, to a greater or lesser degree, for each of the single Battles created. It should be appreciated that each board size will influence the setup of the starting positions of its pieces, and so will the characteristic moves of the Archer, Mage and Gatekeeper as each requires a large number of spaces to move in.

Figure 24:
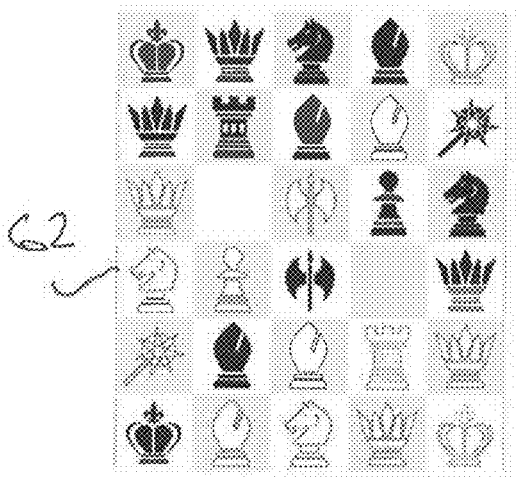

Referring now to FIG. 24, and in this embodiment of the present invention which is a second sample of a single Battle on a different sized game-board, a 5×6 square board 62, where there is no Archer present and 1 Pawn, 1 Rook, 3 Bishops, 2 Knights, 2 Kings, 2 Queens, 1 Mage and 1 Gatekeeper and two spaces per side.

Figure 25:
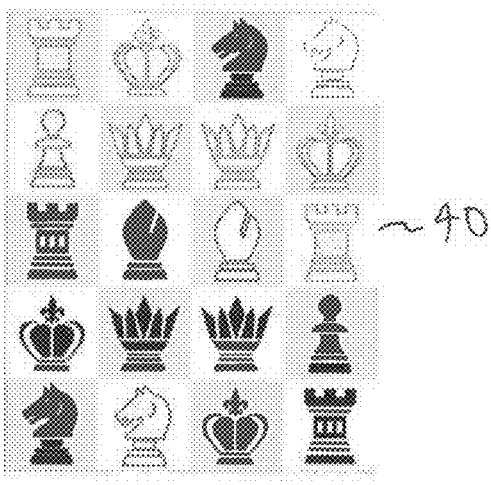

Referring now to FIG. 25, and in this embodiment of the present invention which is the third sample of a single Battle on a different sized game-board, a 4×5 square board 40, where there are only the six standard chess pieces on the board including 1 Pawn, 2 Rooks, 2 Bishops, 2 Knights, 2 Kings, 2 Kings and no spaces per side. Where in the 6×6 square game-board 64 and up through the 8×8 square game-board 72, there is normally at least 1 Mage, 1 Archer, and 1 Gate-Keeper, in the smaller boards their presence is limited due to the smaller size of the number of available squares on the game-boards.

Referring now to all three sample Battles in FIGS. 23-25, and citing these as being representative of the overall chess variant where some or all of the pieces 42-58 characteristically fill the vast majority and, at times, up to 100% of a game-boards' spaces.

Referring now to all three sample Battles in FIGS. 23-25, another essential characteristic of this chess variant is that opposing pieces from 42-58 are often in close proximity to one another, and this creates a characteristic dynamic or "tension" where each player knows and anticipates that they can immediately take one or more of the opponent's pieces 42-58 and their corresponding pieces 42-58 can be taken just as quickly. It should be appreciated that this characteristic dynamic ebbs and flows during the course of playing each Battle, and may naturally diminish as pieces 42-58 from each side are taken and the number of pieces 42-58 on each player's side is reduced.

Referring again to FIGS. 23-25, another characteristic element inherent in the design of each Battle's starting positions is that the spaces that remain empty are often an integral part of the game's design, and are often left empty to avoid having a piece in a space that would otherwise serve as a point of ricochet for the Gatekeeper, Archer or the Mage. For example, a given space may have been left empty to avoid creating a "path" where the Archer might be able to take multiple pieces in its first move. The larger game-boards, i.e., the 6×7 square game-boards 66 and up through the 8×8 square game-boards 72, tend to have more empty spaces given their increased number of spaces, where the smaller game-boards, i.e., the 6×6 square game-boards 64 and down through the 4×5 square game-boards 40, conversely tend to have fewer empty spaces.

Wars:

Referring to FIG. 22 illustrating the definition of a War as a series of an odd-number of Battles, and also referring to FIG. 26 which is a flowchart illustrating the variation of Battles presented in a War, each Battle presented and varied is based partly on the playing history of one or more players. The order in which Battles are served to players may first be Battles not yet played and then varied where the ordering of Battles played in succession can be shuffled, and then where the orientation of the game-board 40 and 60-62 can be rotated or otherwise varied.

A regulation War is defined by the playing of three or more regulation Battles, played in succession on one or more game-board sizes and with only short pauses in-between. The specific War is generally defined by an odd-number of Battles agreed to prior to playing the War, usually a collection of three, five, seven, nine or eleven Battles. These Battles are played on either one game-board size or in one embodiment of the present invention may be played on a combination of game-board sizes which can be called a Hybrid War.

Referring again to FIG. 22, Wars are defined as an odd-number of Battles where the winner will claim victory by winning the majority of Battles played. For example, an agreed upon War of five Battles played on the 6×6 square game-board 64 will be won by the first player to win three Battles, or "3 out of 5" and, if both players had each won two Battles in this case, then playing the fifth Battle would be the tie-breaker, as there are no ties in this chess variant.

Shuffling the Order of Battles:

Referring to FIG. 26, the order and variety of the Battles served also defines the War which unfolds in real time. A computer process that serves the Battles in real-time is structured to test a player's skill in the language of the game and to deter reliance on memorization of a Battle's starting positions. The order in which Battles appear and reappear will be partly based on the playing histories of the players. For example, a War consisting of the three Battles illustrated in FIG. 23, FIG. 24 and FIG. 25, played at first in consecutive order, could be shuffled and presented in reverse order when served the next time to one or both players.

As illustrated in FIG. 26, a first player "A" plays a Battle as shown in block 180 and a second player "B" plays a Battle as shown in block 182. After the players play a Battle, the players may be followed by other Battles as shown in block 184. Battles not played previously as shown in block 186 and battles in different order than previously played as shown in block 188 may be presented to the players. Battles in different board orientations than played previously as shown in block 190 and Battles in different board rotations than played previously as shown in block 192 may be presented to the players. Wars and Hybrid Wars with Battle combinations not played previously as shown in block 194 may be presented to the players. A database tracks the history of Battles played as shown in block 196 for the players. It should be appreciated that, when serving Battles to two players simultaneously, the computer 12 will approximate a fair average in its selection and adjust results to reflect skill levels when possible as shown in block 198.

Game-Board Rotations:

Referring to FIGS. 27-30, one embodiment of the present invention is that almost all of the Battles and their respective game-boards 40 and 60-72 are designed to be rotated to vary the presentation and orientation of the starting positions of the pieces 42-58. Combined with game-board rotations, there can be sixteen variations of presenting the same Battle including "Switching Sides," and a unique technique called "Ghost Mode," where a player's Pawn travels "backwards and down the board" as opposed to the Pawn's standard direction of travel which is "forwards and up the board."

Referring again to FIG. 27 (same Battle as FIG. 23), the starting positions on the game-board 64 of this Battle at zero degrees (0°), without rotation can be reviewed. Referring to FIG. 28, the game-board 64 is now rotated at a ninety degree (90°) angle while keeping the exact same starting positions with the following exception. Note that in addition to challenging the player from a different visual perspective, the Pawn's direction has been re-oriented (See Pawn Direction Indicator) and this now affects the experience of playing the game. When at 0°, without rotation (see FIG. 27) the Pawn on the space E3 could take the Bishop diagonally/up and to the left. Note that when the game-board 64 is rotated 90° (See FIG. 28) how the same Pawn at space C2 cannot take any piece—which changes the dynamic of the way the Battle might be played and its eventual outcome.

Referring to FIG. 29, the game-board 64 is rotated 180° and while it may seem that the only technical change (when referencing FIG. 27 when at 0°) is in the color of the pieces 42-58, the visual and psychological presentation is varied as the players' pieces 42-58 change color and orientation and will seem unfamiliar at first glance given the complexity of the starting positions.

Referring now to FIG. 30, the rotation of the game-board is now 270°, while continuing the same principle of rotation and variation, where the colors of the pieces 42-58 have changed (see FIG. 28 at 90°) and again the Pawn's direction has been re-oriented (See Pawn Direction Indicator).

In Summary, there are four physical rotations of the game-board which obscure a player's first impression and familiarity of the starting positions of a Battle first presented at the 0° position.

Switching Sides and Ghost Mode:

Referring now to FIGS. 31-34, in addition to the four physical game-board rotations (illustrated in FIGS. 27-30), a new technique is illustrated which can be called, "Switching Sides" (a.k.a. Switched-Sides), where the orientation changes as to which color pieces 42-58 belong to Player A's side and which color pieces 42-58 belong to Player B's side. Referring to FIG. 31, if Player A originally played the same Battle in FIG. 27 as Blue (black in the drawing) then when Player A has to "Switch Sides" (see FIG. 31), he or she now plays the same Battle but as Gold (white in the drawing). As before, their Pawns "move forward and up the board (see Pawn Direction Indicator) but they have switched sides and now play as the opposite color in the same Battle which requires a 'mental switch' in orientation."

In Summary, adding to the four physical game-board rotations, we can count four more ways of playing those rotated game-boards by Switching Sides . . . or eight ways of varying the presentation of a given Battle.

Referring now to FIGS. 35-38, a Battle can also be played on each of the four physical rotations of the game-board 64 (see FIGS. 27-30) in "Ghost Mode," playing with the Pawn moving backwards and towards you, or "back and down the board". Referring to FIG. 35, if Gold (white in the drawing) note the Gold is played Pawn's direction is now coming "back towards you" (See Pawn Direction Indicator). This is a psychological "twist" of logic where the player was used to moving the Gold Pawn "forwards and up the board," now is moving the Gold Pawn "backwards and down the board." In fact, the Pawn is being moved back towards where the player is 'sitting' which is the opposite of what every chess player learns and practices. This technique of playing is called "Ghost-Mode" because it is as if you are playing seated on the far side of the board like a ghost (facing yourself).

In Summary, adding to the four physical game-board rotations and the four ways of Switching Sides within those rotations, we can count four more ways of playing the four physically rotated game-boards now in Ghost Mode . . . or twelve ways of varying the presentation of a given Battle.

Referring now to FIGS. 39-42, the four Switched-Side orientations of the game-board 64 (see FIGS. 35-38) can be played in Ghost Mode, reversing the Pawn's direction so it moves "backwards and down the board" towards where the player is sitting.

In Summary, adding to the four physical game-board rotations, the four ways of Switching Sides within those rotations, and the four ways of playing the physically rotated game-boards in Ghost Mode, now we can count four more ways by playing the Switched Side orientations in Ghost Mode . . . or sixteen ways of varying the presentation of a given Battle.

Bonus Battles:

The unique pieces 42-58 and variations of presenting the starting positions of the Battles have been designed in part to minimize opportunity for cheating and relying on memorization by humans. Even more important, it is structured this way so that the players rely on their skill of interpreting and learning the "language" of the chess variant.

There are approximately eighty-eight Battles, divided approximately equally amongst the different game-board sizes, or approximately eleven regulation Battles with approximately sixteen different ways of presenting a single Battle through game-board rotations, Switched-sides and Ghost-Mode changes in orientation as described above and illustrated in FIGS. 27-42.

In one embodiment of the present invention, when a player has experienced a single Battle repeatedly, even after playing that same Battle with most or all of its variations in orientation, new "Bonus Battles" can be served which that player has never played before. It should be appreciated that there are potentially unlimited numbers of Bonus Battles which can be added into the overall game over time and these may eventually replace older regulation Battles to both increase the variation and minimize memorization of starting positions.

Hybrid Wars:

One embodiment of the present invention is where Battles from two or more game-board sizes are alternated and combined in a Hybrid War. For example, if a War of three Battles includes one or more Battles from the 4×5 square game-board 40 and one or more battles from the 5×5 square game-board 60 it is said to be a Hybrid War. Alternating Battles from three game-board sizes, four game-board sizes, and up to eight different game-board sizes in Hybrid Wars becomes another method to vary the overall game and test a player's skill.

Referring to FIG. 43, a flowchart of Hybrid Wars is illustrated. The Initial Battle is played on a specific board size as shown in block 200. The Initial Battle is followed by other Battles as shown in block 202. Other Battles played on the same board size as the Initial Battle was played-on as shown in block 204 and other Battles played on different board sizes than the Initial Battle was played on as shown in block 206 may be presented to the players. A Hybrid War defined as a Level in the game combining different board sizes in an odd-number of Battles as shown in block 208 may be presented to the players. After the Hybrid War, the order of Battles served to the players are often shuffled with different board orientations than played previously is shown in block 210. The winner of the majority of Battles in the Hybrid War wins as shown in block 212.

When a Hybrid War alternates Battles from different game-board sizes and when the order of the over eighty eight Battles are shuffled, and where the game-boards are rotated with added variations of Switched Sides and Ghost Mode in up to sixteen different orientations of each Battle, the number of mathematical permutations and combinations of ways of serving Battles to players can be numbered in the millions. In addition to developing skills in the language of the chess variant, this variety serves to minimize reliance on memorization and reduce cheating to enable fair play when playing online with browsers or downloaded apps in mobile devices or any other form of digital media.

Levels and Ranking:

One embodiment of the present invention is that the overall game is organized in multiple skill Levels. These skill Levels are grouped and defined by the Battles and Wars played on the different game-board sizes. Once a Level has been completed on a specific game-board size, the next Level that follows usually culminates in a series of Hybrid Wars combining Battles from some, or all, earlier Levels with their respective game-board sizes.

To become ranked and graduate from one Level to the next, a player needs to compete in Wars with timed-moves at each Level against other players. Data is collected and analyzed including a player's win/loss ratio with an ELO scoring system (adjusted for skill levels of opponents), Rank Points, and a new Qualitative Skill Correlation (QSC) score.

Referring to FIG. 44, which is a flowchart illustrating a system of Levels in the game. The Game Level is shown as shown in block 214 and the Battles played on game-board sizes used in a Level are shown in block 216. Once a predetermined number of Wars are played at a Level, the player graduates to the next Level as shown in block 218. For Level 1 as shown in block 220, Battles are played on game-board size I as shown in block 222 and once a predetermined number of Wars are played at this Level, the player graduates to the next Level as shown in block 224. For example, where after being ranked in the 4×5 square game-board 40 and playing all of its Battles and a number of Wars, a player can be promoted to Level 2 as shown in block 226. For Level 2, Battles are played on game-board size II as shown in block 228 and once a predetermined number of Wars are played at this Level, the player graduates to the next Level as shown in block 230. For example, after being ranked and completing all of the Battles and a number of Wars on the 5×5 square game-board 60 in Level 2, a player can be promoted to Level 3 which will include a number of Hybrid Wars combining Battles from Level 1 and Level 2.

For Level 3, Battles are played on game-board size I+II in block 234 and once a predetermined number of Wars are played at this Level, the player graduates to the next Level as shown in block 236, which is Level 4 as shown in block 238. For Level 4, Battles are played on game-board size III as shown in block 240 and once a predetermined number of Wars are played at this Level, the player graduates to the next Level as shown in block 242, which is Level 5 as shown in block 244. For Level 5, Battles are played on game-board size I+II+III in block 246 and once a predetermined number of Wars are played at this Level, the player graduates to the next Level as shown in block 248, which is Level 6 as shown in block 250. For Level 6, Battles are played on game-board size IV in block 252 and once a predetermined number of Wars are played at this Level, the player graduates to the next Level as shown in block 254, which continues the pattern by playing on new game board size and in the following Level, Battles alternate between some or all prior game-board sizes as shown in block 256. It should be appreciated that this system of graduating through a ladder of Levels continues up through Level XV, where players are ranked in Hybrid Wars alternating Battles from all eight game-board sizes.

Referring to FIGS. 46 and 46*b*, the chance-element methodology to be described can be applied to vary the above-detailed chess variant, Chess-Clash, and/or the game of chess itself (adhering to the normal rules of chess) or other chess variants.

Bet Matching Methodology:

Referring to FIG. 45, one embodiment of the present invention is a system for matching players of different skill levels when two or more players are placing a bet of real or non-real currency on the outcome of the game. As each player becomes ranked by playing games, and the histories of both competitors' skill levels are analyzed, a computer process generates an initial proposal for terms which estimate a fair match and a fair bet. It should be appreciated that the playing history of the player is inputted with the computing device 14 into the computer 12 either through storage on the computing device 14 or playing games on the computer 12. It also should be appreciated that the initial proposal may also be influenced in part by the stated preferences of each player in their membership profile and when requesting to play another player.

Referring again to FIG. 45, the computer 12 may analyze each player's win/loss ratio, ELO Ranking, a proprietary QSC Ranking, game specific Rank Points, and/or other data to determine the overall and specific ranking of a player. In one embodiment of the present invention, a player's rank and experience are made available during a pre-game negotiation process between the two players and can provide insight into a competitor's strengths and weaknesses prior to placing a bet. Overall rank can be determined by at least three types of data gathered on each player:

an ELO system of scoring which considers a win/loss ratio and adjusts a basic ranking up or down when considering the skill levels of the opponents played in a specific game; and a new measurement called Rank Points which are awarded for use of techniques known to be specific to the game played.

A measurement called Quantitative Skill Correlation (QSC), which measures how a player adjusts their efforts when playing equally skilled or more advanced players than themselves and is a game-specific score.

One embodiment of the present invention is a skill analysis calculation called Qualitative Skill Correlation, or QSC, which quantifies skill sets a player relies on and utilizes when under stress, competitively. A player's QSC score is tallied primarily when competing against an opponent of equal or more advanced skill and when playing a ranked game. QSC can measure real-time techniques during a contest including time taken to move, lost opportunity, time taken to enact a successful strategy, intentional sacrifice which proves effective, overall endurance, ability to make a comeback, ability to adjust to a specific technique used by the opponent when under attack, finding a weakness in the opponent's defense, overcoming the opponent's advantage with a specific technique, and other game strategies when and where measurable.

A high QSC ranking when combined with a moderate ELO ranking and a high Rank Point score might indicate, for example, that the competitor has played more advanced players and their win/loss ratio is not revealing of their true skill and resourcefulness. A low QSC ranking when combined with a high ELO ranking and a low Rank Point score conversely might indicate that the competitor has played less skilled players but does not necessarily possess a competitive advantage over an equally skilled or more advanced competitor with a lower ELO ranking but higher Rank Point and higher QSC scores.

Referring to FIG. 45, a flowchart of the bet-matching methodology is illustrated. The first player has a playing history and preferences as shown in block 300 and a second or other players' have a playing history(s) and preferences as shown in block 302. The computer 12 analyzes the players' skills and playing characteristics as shown in block 304. The computer 12 considers players' experiences with game levels, features, and options available which may define the specific match or contest as shown in block 306. An initial proposal is generated by the computer 12 for a fair match, which may include handicaps as shown in block 308. The initial proposal may be time-limited for requiring a response as shown in block 310.

The initial proposal may include the same or individual bet amounts, and the same or separate times per turn both for the overall match or contest or for separate smaller sections as shown in block 312. The initial proposal may include difficulty level, length and/or speed of match or contest, and different features or may include the same or different degrees of chance-events applied to the overall match or contest or to separate smaller sections as shown in block 314.

One embodiment of the present invention includes the game's initial proposal being made to both players simultaneously. When this occurs, both players have the opportunity to adjust and negotiate the terms. The initial proposal might propose a general game-level of play and length of game (if relevant), and with different settings for each player with regard to time per move, bet amount, adding degrees of chance elements, who goes first, use of game-specific techniques and other adjustments and settings which can affect the outcome of the multi-player game of skill especially where specific skill techniques are measurable and variable.

Referring again to FIG. 45, a player accepts, declines, or can adjust the initial proposal and submit a counter proposal to the opponent(s) as shown in block 316. The initial proposal can be further refined by the players themselves through communication in a series of a limited number of counter-proposals as shown in block 318. In one embodiment of the present invention, the negotiation is time limited as shown in block 320 and the lower-ranked player may have the first option to either accept, decline or make a counter-proposal. The next player might accept, decline, "meet in the middle," or return to the initial proposal, or make their own counter-proposal. This may include options to compromise or "meet in the middle" or review the previous offer as shown in block 322. After a limited number of counter-proposals and if the terms of a match are accepted by all players within time limits allowed, the match may begin as shown in block 324. It should be appreciated that the goal is to more fairly match one player against the other by facilitating further ranking or a fair bet of real or non-real currency on the outcome of the game between two competitors of different skill levels when playing any games of skill either online or with downloaded apps on mobile devices or other digital media.

Chance Element Methodology:

Referring to FIG. 46, an overview of a Chance Element Methodology enabled through a computer process of the present invention is illustrated. The process can apply an element of chance to chess, poker or any other game of skill or variants of existing skill games to vary the game unexpectedly to even-out the odds between players of different skill levels. As the resulting game will depending partly on the luck of unpredictable and randomized occurrences, it will facilitate betting on the outcome of the game where cheating by humans and computers can be minimized.

In one embodiment of the present invention, the process can alter the pieces on a game-board, cards in the game, other game assets or resources randomly prior to each move or during a player's turn in any game of skill, by altering at least one or more of the following elements:

remove from the game, one or more piece(s), cards, props, tools, materials, game assets or resources, prior to the next player's turn or during a turn;

return to the board one or more piece(s), cards, props, tools, materials, game assets or resources which was previously removed, prior to the next player's turn or during a turn;

restrict use of one or more piece(s) or empty space(s) on a game board, or cards in a deck, or props, tools, materials game assets or resources prior to the next player's turn or during a turn;

add to the game, one or more piece(s), cards, props, tools, materials, game assets or resources, prior to the next player's turn or during a turn;

change a rule, alter a requirement, or interfere positively or negatively with of one or more pieces(s), cards, props, tools, materials, game assets or resources, prior to the next player's turn or during a turn; and/or change the nature of which a turn is taken by altering speed, changing environment, decoration, weather, geography, visual presentation of the place where the game is being played or spatially altering the space, or any other shift in character of presentation which can influence the way they game may be played prior to the next player's turn or during a turn.

Referring to FIG. 46, a flowchart of the chance element methodology is illustrated. Prior to each move or turn of a player as shown in block 400, the computer 12 may review the players' playing history as shown in block 402 or may review the players' skills in the current game and expectations of which player may win or lose as shown in block 404. The computer 12 analyzes the rules and game in progress as shown in block 406.

In one embodiment of the present invention for example, the computer 12 can analyze the number and quality of pieces remaining on a game board, for example. A value, or weight, can be determined for each piece and/or empty space in the context of the game being played and when a change is made to one player's piece(s) prior to their move, a similar change of close or equal weight may be applied prior to the next player's move.

Referring to FIG. 46, the computer 12 may include a random number generator and process to compute a value or weight as shown in block 408. The computer 12 may consider technical weight assigned to each resource and asset as shown in block 410 or may apply approximately equal weight when adjusting each resource or asset for each player as shown in block 412. The computer 12 adjusts resources and assets during game-play as shown in block 414. It should be appreciated that a resource or asset may be, for example in the game of Chess, one of the pieces 42-58.

As illustrated in FIG. 46, as the game progresses, the process can change accordingly and as the number of pieces on the game board decreases, the process may start to return more pieces to the board, for example, or otherwise adjust its actions accordingly to fit the game being played. For example, the computer 12 may restrict fewer or less valued pieces, and start to restrict use of certain empty spaces to block movement of remaining pieces while still making available the physical use of those pieces in the game.

Referring to FIG. 46, the computer 12 can restrict resources and assets as shown in block 416, remove resources and assets as shown in block 418, return resources and assets as shown in block 420, adds resources and assets as shown in block 422, change resources and assets as shown in block 424, allow use of resources and assets as shown in block 426, apply new uses of resources and assets as shown in block 428, and apply different environments for resources and assets as shown in block 430. The computer 12 may include adjustments of bet amounts and time per turn as shown in block 432. The computer 12 refines adjustment of the resources and assets in continuation of game play as shown in block 434. As the game dynamics change, adjustments may vary as shown in block 436 and the rules of game play may influence adjustments as shown in block 438. As a player is winning, adjustments of the resources and assets may increase weight proportionally in favor of player that is losing as shown in block 438.

For the overall methodology of FIG. 46, the element of chance may be added to any skill game that detracts from the ability to plan a series of moves and thus the odds of winning become more equally divided between two players of different skill levels. A random change to the board may be good for one player's next move, but not for the other player regardless of skill. It should be appreciated that this will allow a less-skilled player the opportunity to play or bet against a more advanced player, and now with an improved chance of winning where they might have had little or no chance before.

For example, the element of chance may be applied to any skill game to render cheating by a computer ineffective since robots, or "bots," will not be able to enact strategies or plan with accuracy beyond a single turn. A human might choose the same move, or take the same turn as a "bot" when determining the best move to make, or the best turn to take. It should be appreciated that the "best move" or "best turn", however, may not have been the best to make, in retrospect, once both players see which pieces, cards, or game assets or resources are available in their next turn, which is unpredictable.

More particularly, the level of chance-element applied can be different for each player and negotiated as part of a bet-matching process prior to or during the game. In one embodiment of the present invention, a bet-matched proposal might recommend a larger percentage of chance-element being applied to the more advanced player and a lesser percentage of chance-element influence on the game being applied to the less skill player.

Referring to FIG. 46*a*, a flowchart of a specific application of a variation of Poker, which can be applied to and modified for any variant of online Poker, using the Chance-Element Methodology is shown. In this specific and original game or application, Poker Morph, the deck is modified and starts with an additional Jack, Queen, King and Ace of different colors and suits which are randomly assigned, and varied with each new hand. The additional high cards create new probabilities of generating hands with multiple same-valued cards of Jacks, Queens, Kings and Aces. In addition, the probability of a straight, flush, straight flush or royal flush increases significantly. In one embodiment of the present invention, the odds may be that lower cards (2, 3, 4, 5, and 6) are more likely to transform upwards to a higher number than higher value cards would be likely to transform down, thus supporting the probability of resulting higher valued hands of a straight, flush, straight flush, royal flush, or multiple cards of Jacks, Queens, Kings and Aces and these probabilities might be published and become part of the overall game. It should be appreciated that, in one embodiment of the present invention, a small percentage of cards may transform down in face-value.

As illustrated in FIG. 46*a*, the online Poker variant starts as shown in block 500. Additional cards may be added or subtracted to the deck of cards, which will be made available to players as shown in block 502 and probability of ranking hands made available to players as part of the overall game as shown in block 504. For the process, cards are dealt to players face-down or face-up as community cards, depending on the Poker variant as shown in block 506. During timed move at some, or different, time per player as shown in block 508, prior to each player's action, for example, ante, bet, call, fold, raise, etc. as shown in block 510, the computer 12 analyzes cards dealt and changes the face value of some cards as shown in block 512. For example, cards changed are returned to the deck with some at the top, middle or bottom of the deck as shown in block 514, where the probability of placement of cards in remaining deck are made available to players as shown in block 516, the probability of cards changing face value are made available to players as shown in block 518, and where specific cards may change to higher or lower face value as part of overall game as shown in block 520.

In one embodiment of the present invention using the popular poker variant, Texas Hold'em, as an example, where after the dealer has dealt the first set of cards to each player face down on the table, there is a high probability that one or more cards may transform in one or more player's hands during the timed-turn. The original card(s) would instantly be returned and placed randomly to the deck. In one embodiment of the present invention, players are informed on the probability of how many cards will transform and the odds of returning them randomly in the top, middle or bottom of the remaining deck giving the players additional statistical information to consider.

Referring again to FIG. 46*a*, the players take action of placing a bet, making a call, folding, raising a bet, etc. as shown in block 522. The process repeats as additional cards are dealt to players face-down or face-up as community cards, depending on the Poker variant, as shown in block 524. The change of cards' face values are made, to a greater or lesser degree, to all cards previously dealt as shown in block 526 and a smaller probability of cards changing face value where previously dealt may apply and is available to players as shown in block 528. The process repeats until a final wager is made and a winner is determined as shown in block 530.

In one embodiment of the present invention, once the dealer has dealt the Flop, or three community cards face upwards, the odds are that at some point during the timed turn that that one or more of the three community cards will transform, but less of a probability that one or more of the initially dealt face-down cards will transform. Again, cards which have been transformed are randomly returned to the deck.

Once the dealer has dealt the Turn, or one community card face up, there may be lower odds that the Turn card will transform and still lower odds that one or more of the three Flop cards will transform and increasingly lower odds still that one or more of the two cards which are face down will transform in one or more player's hands. Again, cards which have been transformed are returned to the deck.

Once the dealer has dealt the River, or one final community card face upwards, the odds are slight that during the timed turn the River car will transform, and still lower odds that the Turn card will transform, and increasingly lower odds still that the one or more of the three Flop cards will transform, and even lower odds that one or more of the two face-down cards initially dealt will transform in one or more player's hands. Again, cards which have been transformed are returned to the deck.

The combined result will probably be that players will remain in the game longer to determine if the additional cards are added to the deck, and the transforming of cards will improve their odds of having a winning hand. This may also result in higher bets or bigger pots being bet on. It should be appreciated that a software robot or bot would not be able to calculate which cards were returned to the deck from any combination of face-down cards in any poker variant. It should also be appreciated that each player would have more knowledge than a bot could have, as to which cards are "out" in the deck, including a less advanced player who could use that information to beat an even more skilled player. It should further be appreciated that, in a pre-game negotiation with bet-matching, a less advanced player could negotiate more time per turn, have smaller blinds or antes, or could match raises with fewer chips than bet by the other player, for example.

Referring to FIG. 46*b*, a flowchart of a specific application of the Chance-Element Methodology to the skill game of Chess, Chess-Clash, or any chess-variant is shown. The online chess, or chess variant, game starts as shown in block 600. The computer 12 analyzes the game-board and the number and value of pieces on the game-board and applies chance-element methodology accordingly as shown in block 602. The computer 12 may review previous moves, if any, by both players in block 604, may consider strongest potential moves as shown in block 606, may review players' ranks and playing history as shown in block 608, and/or may review strategic strength of pieces and spaces on game-board as shown in block 610. The computer 12 may use a random number generator, which may apply different degrees of chance-element(s) as shown in block 612. Prior to the first player or Player One's turn, the computer 12 adjusts assets and resources to alter the game-board for Player One's turn as shown in block 614. The computer 12 may restrict space(s) or piece(s) as shown in block 616, may restrict other player's pieces as shown in block 618, may add piece(s) as shown in block 620, may move piece(s) as shown in block 622, may remove piece(s) as shown in block 624, may return piece(s) as shown in block 626, and/or may rotate or alter the game-board as shown in block 628. After the adjustment, Player One moves as shown in block 630.

Prior to the second player or Player Two's turn, the computer 12 adjusts assets and resources to alter the game-board for Player Two's turn as shown in block 632. The process of analysis and chance-element adjustments of the game-board 40 and 60-72, as previously described, is repeated as shown in block 634. As pieces and strategies change with each move, the computer 12 adjusts accordingly as shown in block 636. After the adjustment, Player Two moves as shown in block 638. The process repeats until the game is over as shown in block 640. It should be appreciated that, as the game progresses, the computer 12 may or may not give preference to either player, but attempts a random result as shown in block 642.

In another embodiment of the present invention, the chess-variant(s) will be played on different sized or multi-leveled game-boards in 3D, or on a physical game board and a hologram-based game board which is currently on the market, and where computing devices 14 communicate with all or some of the pieces 42-58 on the game-board which may include one or more of 40 and 60-72. Other virtual reality settings or other digital expressions as gaming devices currently exist on the market and will be used for skill games including the chess, Chess-Clash, other chess-variants, Poker Morph and other applications of the chance methodology as described above to any poker or card game. New technology and gaming solutions not yet expressed or with technologies not yet invented will be used to play these and other skill games in the future, with betting and with bet-matching and chance element methodology features as described above where all can be combined into one game experience.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A system for providing matching of bets for an online skill game to a plurality of players comprising:

a display device for displaying the game;

a computer coupled to the display device, the computer having memory for storing the game;

at least one controller coupled to the computer and display device, the at least one controller being configured for allowing a playing history of a first player and a second player to be inputted into the computer;

wherein the computer is configured to analyze a skill level of the first player based on the playing history of the first player, to analyze a skill level of the second player based on the playing history of the second player, to generate an initial proposal for a fair match between the first player and the second player based on the analyzed skill levels, and to communicate the initial proposal to the controller of either one of the first player or the second player; and wherein either the first player or the second player accepts or rejects the initial proposal by communicating the acceptance or rejection with the controller to the computer, wherein the game includes a plurality of modifiable settings, wherein the computer is further configured to randomly modify at least one of the modifiable settings if the first and second players have different skill levels and/or one of the players has an advantage during game play.

2. A system as set forth in claim 1, wherein said computer generates the initial proposal for a fair match based on at least one of handicaps, bet amounts, timer per move, skill level for a match, length of match, and other technical settings.

3. A system as set forth in claim 1 wherein a lower ranked player of the first player and second player accepts, rejects, or adjusts the initial proposal with the controller to the computer and submits a counter-proposal with the controller to a higher ranked player of the first player and second player via the computer.

4. A system as set forth in claim 3 wherein the high ranked player submits a first counter-proposal with the controller to the lower ranked player via the computer.

5. A system as set forth in claim 4 wherein the lower ranked player receives the first counter-proposal via the computer to the controller, compares the counter-proposal to the initial proposal, and accepts, rejects, or adjusts the first counter-proposal by the lower ranked player via the controller.

6. A system as set forth in claim 5 wherein the first player and second player submit a series of counter-proposals and responses to and from each other via the controller and computer.

7. A system as set forth in claim 6 wherein the first player and the second player meet in the middle or return to the initial proposal via the controller and computer.

8. A system as set forth in claim 7 wherein said computer begins the match if the bet and other parameters are accepted by both the first player and the second player via the controller within the time limits allowed.

9. A system as set forth in claim 1 wherein the game of skill is one of chess or cards.

10. A system as set forth in claim 1, wherein the computer randomly modifies at least one of the modifiable settings as a function of the analyzed skill levels and/or selection(s) by one or more players.

11. A system as set forth in claim 1, wherein the at least one modifiable settings include measurable levels and/or techniques comprising game play.

12. A system as set forth in claim 1, wherein the modification to the modifiable settings is included in the initial proposal.

13. A system as set forth in claim 1, wherein the at least one modifiable setting is randomly modified during play.

14. A system for providing matching of bets for an online skill game to a plurality of players, comprising:

a display device for displaying the game;

a computer coupled to the display device, the computer having memory for storing the game;

at least one controller coupled to the computer and display device, the at least one controller being configured for allowing a playing history of a first player and a second player to be inputted into the computer;

wherein the computer is configured to analyze a skill level of the first player based on the playing history of the first player, to analyze a skill level of the second player based on the playing history of the second player, to generate an initial proposal for a fair match between the first player and the second player based on the analyzed skill levels, and to communicate the initial proposal to the controller of either one of the first player or the second player; and wherein either the first player or the second player accepts or rejects the initial proposal by communicating the acceptance or rejection with the controller to the computer, wherein said computer is configured to, prior to each move or turn by the first player or the second player, analyze with the computer rules and game in progress, adjust resources and assets during game-play, refines adjustment of resources and assets in continuation of game-play, and adjusts element of chance as one player is winning toward the other player that is losing.

15. A system as set forth in claim 14 wherein said computer is configured to adjust resources and assets during game-play by at least one of restricting resources and assets, removing resources and assets, returning resources and assets, adding resources and assets, changing resources and assets, allowing use of resources and assets, applying new uses of resources and assets, and applying different environments for resources and assets.

16. A method for providing matching of bets in an online skill game to a plurality of players, said method comprising the steps of:

displaying the game with a display device;

storing the game with a computer coupled to the display device;

inputting with at least one controller a playing history of a first player and a second player into the computer;

analyzing with the computer a skill level of the first player based on the playing history of the first player;

analyzing with the computer a skill level of the second player based on the playing history of the second player;

generating with the computer an initial proposal for a fair match between the first player and the second player based on the analyzed skill levels;

communicating with the computer the initial proposal to the controller of either one of the first player or the second player; and accepting or rejecting the initial proposal by either the first player or the second player and communicating the acceptance or rejection with the controller to the computer, wherein the game includes a plurality of modifiable settings, wherein the method further includes the step of randomly modifying at least one of the modifiable settings if the first and second players have different skill levels and/or one of the players has an advantage during game play.

17. A method as set forth in claim 16 wherein said step of generating comprises generating the initial proposal for a fair match based on at least one of handicaps, bet amounts, timer per move, skill level for a match, length of match, and other technical settings.

18. A method as set forth in claim 16 including the steps of, prior to each move or turn by the first player or the second player, analyzing with the computer rules and game in progress, adjusting resources and assets during game-play, refining adjustment of resources and assets in continuation of game-play, and adjusting element of chance as one player is winning toward the other player that is losing.

19. A method as set forth in claim 18 including the step of adjusting resources and assets during game-play by at least one of restricting resources and assets, removing resources and assets, returning resources and assets, adding resources and assets, changing resources and assets, allowing use of resources and assets, applying new uses of resources and assets, and applying different environments for resources and assets.

20. A method as set forth in claim 16 wherein the game of skill is one of chess or cards.

21. A method as set forth in claim 16, wherein the at least one of the modifiable settings is randomly modified as a function of the analyzed skill levels and/or selection(s) by one or more players.

22. A method as set forth in claim 16, wherein the at least one modifiable settings include measurable levels and/or techniques comprising game play.

23. A method as set forth in claim 16, wherein the modification to the modifiable settings is included in the initial proposal.

24. A method as set forth in claim 16, wherein the at least one modifiable setting is randomly modified during play.

25. A method for providing matching of bets in an online skill game to a plurality of players, said method comprising the steps of:

displaying the game with a display device;

storing the game with a computer coupled to the display device;

inputting with at least one controller a playing history of a first player and a second player into the computer;

analyzing with the computer a skill level of the first player based on the playing history of the first player;

analyzing with the computer a skill level of the second player based on the playing history of the second player;

generating with the computer an initial proposal for a fair match between the first player and the second player based on the analyzed skill levels;

communicating with the computer the initial proposal to the controller of either one of the first player or the second player; and accepting or rejecting the initial proposal by either the first player or the second player and communicating the acceptance or rejection with the controller to the computer, wherein said step of accepting or rejecting comprises a lower ranked player of the first player and second player accepting, rejecting, or adjusting the initial proposal and submitting a counter-proposal with the controller to a higher ranked player of the first player and second player via the computer.

26. A method as set forth in claim 25 including the step of submitting a first counter-proposal with the controller from the high ranked player to the lower ranked player via the computer.

27. A method as set forth in claim 26 including the step of receiving the first counter-proposal by the lower ranked player, comparing to the initial proposal, and accepting, rejecting, or adjusting the first counter-proposal by the lower ranked player via the controller.

28. A method as set forth in claim 27 including the step of submitting a series of counter-proposals and responses to and from the first player and second player via the controller and computer.

29. A method as set forth in claim 28 including the step of meeting in the middle or returning to the initial proposal between the first player and the second player via the controller and computer.

30. A method as set forth in claim 29 including the step of beginning the match if the bet and other parameters are accepted by both the first player and the second player within the time limits allowed.

31. One or more non-transitory computer-readable storage media, having computer-executable instructions embodied thereon, wherein when executed by at least one processor, the computer-executable instructions cause the processor to:

display a game on a display device;

provide a game of skill stored on the display device;

input a playing history of a first player and a second player into the display device;

analyze a skill level of the first player based on the playing history of the first player;

analyze a skill level of the second player based on the playing history of the second player;

generate an initial proposal for a fair match between the first player and the second player based on the analyzed skill levels;

display the initial proposal; and accept or reject the initial proposal by either the first player or the second player, wherein the game includes a plurality of modifiable settings, wherein the computer-executable instructions further causes the processor to randomly modify at least one of the modifiable settings if the first and second players have different skill levels and/or one of the players has an advantage during game play.

32. One or more non-transitory computer-readable storage media, having computer-executable instructions embodied thereon, wherein when executed by at least one processor, the computer-executable instructions cause the processor to:

display a game on a display device;

provide a game of skill stored on the display device;

prior to each move or turn by the first player or the second player, analyze with the computer rules and game in progress, adjust resources and assets during game-play, refine adjustment of resources and assets in continuation of game-play, and adjust element of chance as one player is winning toward the other player that is losing;

input a playing history of a first player and a second player into the display device;

analyze a skill level of the first player based on the playing history of the first player;

analyze a skill level of the second player based on the playing history of the second player;

prior to each move or turn by the first player or the second player, analyze with the computer rules and game in progress, adjust resources and assets during game-play, refine adjustment of resources and assets in continuation of game-play, and adjust element of chance as one player is winning toward the other player that is losing;

generate an initial proposal for a fair match between the first player and the second player based on the analyzed skill levels;

display the initial proposal; and accept or reject the initial proposal by either the first player or the second player.

* * * * *